US006662886B2

(12) United States Patent
Russell

(10) Patent No.: US 6,662,886 B2
(45) Date of Patent: Dec. 16, 2003

(54) MUDSAVER VALVE WITH DUAL SNAP ACTION

(76) Inventor: Larry R. Russell, 3607 Gramercy, Houston, TX (US) 77025-1320

( * ) Notice: Subject to any disclaimer, the term of this patent is extended or adjusted under 35 U.S.C. 154(b) by 99 days.

(21) Appl. No.: 09/824,390

(22) Filed: Apr. 1, 2001

(65) Prior Publication Data

US 2001/0045285 A1 Nov. 29, 2001

Related U.S. Application Data

(60) Provisional application No. 60/194,204, filed on Apr. 3, 2000.

(51) Int. Cl.[7] ..... E21B 23/00; E21B 33/06; E21B 33/14

(52) U.S. Cl. ..... 175/218; 166/237; 166/321; 166/332.3; 166/373

(58) Field of Search ..... 166/373, 374, 166/381, 383, 386, 154, 319, 320, 321, 332.2, 332.3, 334.2, 237; 175/38, 207, 211, 218; 137/535, 536, 538, 539, 540, 544; 251/58, 62, 213, 226, 227, 230, 251, 252, 253, 254, 315.08, 315.1

(56) References Cited

U.S. PATENT DOCUMENTS

| | | | | |
|---|---|---|---|---|
| 2,894,715 A | * | 7/1959 | Bostock | 166/324 |
| 3,007,669 A | * | 11/1961 | Fredd | 137/505.47 |
| 3,035,808 A | * | 5/1962 | Knox | 137/458 |
| 3,126,908 A | * | 3/1964 | Dickens | 137/460 |
| 3,200,837 A | * | 8/1965 | Brown | 137/496 |
| 3,233,860 A | * | 2/1966 | Dollison et al. | 251/218 |
| 3,236,255 A | * | 2/1966 | Sizer | 137/494 |
| 3,543,793 A | * | 12/1970 | Dollison | 137/462 |
| 3,583,442 A | * | 6/1971 | Dach et al. | 137/116.3 |
| 3,743,015 A | | 7/1973 | Mott | |
| 3,965,980 A | | 6/1976 | Williamson | |
| 3,993,136 A | * | 11/1976 | Mott | 137/461 |
| 4,220,176 A | | 9/1980 | Russell | |
| 4,248,264 A | | 2/1981 | Hadsell et al. | |
| 4,262,693 A | * | 4/1981 | Giebeler | 137/494 |
| 4,291,722 A | * | 9/1981 | Churchman | 137/496 |
| 4,377,179 A | * | 3/1983 | Giebeler | 137/494 |
| 4,406,328 A | | 9/1983 | Brooks | |
| 4,446,922 A | * | 5/1984 | Bowyer et al. | 166/322 |
| 4,467,823 A | * | 8/1984 | Shaffer et al. | 137/15.18 |

(List continued on next page.)

OTHER PUBLICATIONS

"Drilco's Mud–Chek Kelly Valve, Publication 16", Drilco Division of Smith International, Inc., 1976.
"General Catalog", p. 31, SMF International, 1996.
Save Money: Make Dry Connections Automatically with the Mud Saver™, Bulletin 110, Arrowhead Continental, 1979.
"AITCO's Mud Saver Valve", American International Tool Co., Inc., undated.
"Introducing the Compact A–Z Mud Saver Valve", A–Z International Tool Company, 1984.

*Primary Examiner*—David Bagnell
*Assistant Examiner*—Jennifer H Gay
(74) *Attorney, Agent, or Firm*—Elizabeth R. Hall

(57) ABSTRACT

A mudsaver valve is described that has a bi-directional snap action in opening and closing the valve. The mudsaver valve is adjustable for different mud weights and includes a preassembled valve cartridge for ease of assembly. Furthermore, elevated pressure from below is readily transmitted past the valve seat, so that the standpipe pressure of the well can be determined through the valve when the pumps are stopped and mudsaver is still connected to the drillstring. One embodiment of the mudsaver valve also contains a mechanism whereby the valve may be locked open by an accessory tube whenever a pipe gets stuck and becomes inaccessible, thereby permitting wireline operations through the valve so that the pipe may be freed.

25 Claims, 13 Drawing Sheets

U.S. PATENT DOCUMENTS 4,467,870 A * 8/1984 Langham ..... 166/321
4,519,576 A * 5/1985 Winegeart ..... 166/321
4,550,780 A * 11/1985 Mott ..... 166/321
4,569,397 A * 2/1986 Brakhage et al. ..... 166/321
4,576,358 A * 3/1986 Mott et al. ..... 166/319
4,632,187 A * 12/1986 Deaton ..... 166/323
4,646,838 A * 3/1987 Manke ..... 166/321
4,651,828 A * 3/1987 Doremus ..... 166/319
4,660,596 A * 4/1987 Ashford ..... 137/496
4,712,613 A * 12/1987 Nieuwstad ..... 166/187
4,889,837 A 12/1989 Ono et al.
5,246,203 A * 9/1993 McKnight et al. ..... 137/454.2
5,509,442 A 4/1996 Claycomb

* cited by examiner

MUDSAVER VALVE WITH DUAL SNAP ACTION

CROSS-REFERENCE TO RELATED APPLICATION

The present application, pursuant to 35 U.S.C. 111(b), claims the benefit of the earlier filing date of provisional application Serial No. 60/194,204 filed Apr. 3, 2001, and entitled "Mudsaver Valve with Dual Snap Action". The present application is related to patent applications, Ser. No. 09/824,374, entitled "Dual Snap Action for Valves" filed on Apr. 1, 2001.

BRIEF DESCRIPTION OF THE INVENTION

The present invention relates in general to a mudsaver valve and particularly to a mudsaver having a rotating ball valve with snap-action for both opening and closing the valve.

BACKGROUND OF THE INVENTION

Mudsaver valves, mounted on the bottom of the drilling rig kelly or top drive, serve to automatically retain drilling mud within the kelly or top drive and its supply hoses and tubing whenever the kelly or top drive is disconnected from the drillstring. The kelly or top drive is routinely disconnected to add or remove pipe from the drillstring.

Retention of drilling mud is desirable in order to avoid the loss of expensive mud, as well as the creation of slick and hazardous working conditions and the resultant loss of time due to rig floor cleanup. The mudsaver functions as a type of relief valve. Whenever the mudsaver is closed, it must support the hydrostatic head of the noncirculating fluid trapped above the mudsaver when the drillstring is separated from the mudsaver. However, when the mudsaver is reconnected in the drillstring, the valve must readily open when the mudpumps are started.

Several previous designs of mudsaver have been created and used, as is discussed below. However, most such designs have had significant drawbacks and are not widely used in the oilfield. Two very significant drawbacks to all of the designs reviewed below is their susceptibility to wear from abrasive fluids and their complex assembly. Partially open valves, particularly ball valves, experience significantly worsened fluid-induced wear rates. This is especially true when used with drilling mud, which is highly loaded with abrasive particles.

In fact, current mudsaver designs are so unsatisfactory that typical operations will retain the mud within the kelly or top drive by manual closure of a valve at the lower end of the kelly, called the kellycock. This situation is highly undesirable because the lower kellycock is a critical drilling safety component intended for occasional or emergency use. In addition, an actuator and its controls must be provided and maintained for the operator to close and open the lower kellycock. Thus, the provision of a suitable autonomous mudsaver would preserve the lower kellycock for its intended safety purposes.

The mudsaver described in U.S. Pat. No. 3,965,980 is one attempt to solve the problems set forth above. The valve described is basically a poppet relief valve. The poppet is spring-biased closed and is opened when drilling mud pressure acting on one side of the piston on the upper end of the sealed spring chamber exceeds the combined resistance of the biasing spring and the counter pressure within the sealed spring chamber. The poppet valve has a check valve mounted concentrically within its head to permit communication of mud pressure from below through the closed poppet for measurement above the mudsaver. Flaws in the design of the valve are its length, multiple-part outer body, difficult assembly and disassembly, and that its sealing plug and seat are subject to high erosion and attendant leakage due to mud circulation impinging both components. Drilco Inc. (a division of Smith International, Inc.) of Houston, Tex. markets the patented valve and SMF International of France markets a similar valve.

U.S. Pat. No. 3,743,015 describes another approach. This mudsaver has a rotatable, translatable ball sealing plug with a through hole. The valve is actuated by differential pressure across an annular piston. On the upper side of the piston, pump pressure acts, while on the other side, a biasing chamber provides a reference pressure (typically atmospheric). The ball is further urged toward its closed position by biasing springs. A means of locking the ball open by means of an externally operated wrench permits wireline operations through the valve. Drawbacks of the valve are the potential leakage paths through the side of its body, high operating forces on the valve with rapid increases in pump pressure or water-hammer, and an involved assembly and disassembly of the large number of parts positioned in crossbores.

A further approach is found in U.S. Pat. No. 4,262,693 which discloses a mudsaver based upon a rotatable, non-translatory ball sealing plug with a through hole. This valve appears to be substantially similar to the mudsaver marketed by Arrowhead Continental, San Bernardino, Calif. An actuation piston is exposed to pump pressure on one side and a second bias pressure in a sealed spring chamber plus a biasing spring force on the second piston face. A net differential pressure causes axial movement of the actuation piston. The actuation piston is coupled to a rotator sleeve by means of one or more piston-mounted camming pins acting in one or more helical grooves in the rotator. Accordingly, axial movement of the piston imparts rotary motion to the rotator, which in turn rotates the ball by means of bevel gears. This mudsaver has relatively high frictional loads and multiple interacting parts.

Yet another approach is seen in the mudsaver valves offered by American International Tool Company, Inc. and A-Z International Tool Company. Their mudsavers retain the mud above the valve by comating annular flat sealing faces transverse to the mudsaver axis dividing an upper annular fluid path from a lower central fluid path. The flat faces are spring-biased together to remain in a closed position under non-flowing mud when the drillstring is separated. The lower flat sealing face constitutes a piston head which is exposed to the pressure above the sealing face on its upper side and the pressure downstream of the annular orifice between the sealing faces on the other side. Pump pressure is sufficient to overcome the spring bias and then the pressure drop across the annular orifice will maintain the valve open. This mudsaver has a coaxial poppet check valve to permit communication of pressure below the valve past the primary valve seal. The primary disadvantage of this valve is the tendency of the sealing faces to wear under direct flow impingement.

U.S. Pat. No. 5,509,442 discloses another mudsaver based upon a rotatable, nontranslatory ball sealing plug with a through hole. An actuation piston is exposed to pump pressure on one side and atmospheric bias pressure in a spring chamber plus a biasing spring force on the second piston face. A net differential pressure causes axial movement of the actuation piston, which in turn can cause valve shifting if permitted by an interlock system controlled by the presence of the abutting end of the drillstring below the valve. The tool is relatively long and has a jointed body which makes assembly and disassembly difficult.

U.S. Pat. No. 4,248,264 discloses a flapper valve-based mudsaver. The flapper is normally biased closed both by gravity and by a torsion spring. The flapper is mounted on an upwardly spring-biased piston ring concentric with the flow passage. Atmospheric pressure is retained within the spring chamber below the piston. When pump pressure forces the annular piston carrying the flapper valve and its seat downwardly, the flapper encounters a fixed annular tube concentric within the valve seat and passing through the annular piston. This unseats the flapper, permitting flow. Pressure from below will either unseat the flapper or, if it is already open, not permit the piston to travel to a position where the flapper will seat. If there is no pressure overcoming the spring bias, the piston moves up against the pressure of the retained mud and closes. This valve gradually opens and closes and is susceptible to wear. Furthermore, pressure surges produce high loadings on the flapper hinges.

U.S. Pat. No. 4,889,837 discloses a poppet-type mudsaver in which the poppet is restrained against downward movement by an integral spider which abuts a stop shoulder. The poppet seat is a spring-loaded annular piston which translates away from the poppet when the pump pressure exceeds the atmospheric pressure acting on the piston area and the spring preload. The poppet is free to reciprocate upwardly if there is pressure from below the closed valve. This valve is not full opening, so it is subject to flow abrasion.

As pointed out above, a mudsaver is subject to tremendous wear from the abrasive particles in the mud. Currently, all of the mudsaver valves open and close in the traditional manner, where the valve is partially open during the opening and closing of the valve leading to rapid wear of the valve.

Several downhole safety valves have attempted to limit wear by incorporating a valve that opens or closes in one rapid movement (a "snap action" valve). For example, U.S. Pat. No. 3,749,119 discloses a valve reopening operator sleeve retained in either an upper position or a lower position by the engagement of annular latch grooves with an annular garter spring. Although closure of the main valve is not impacted by the sleeve, the reopening of the valve is. Shifting of an independent inner sleeve mounted within the valve reopening sleeve downwardly to a first position permits closing an activator valve at the upper end of the reopening sleeve. The closure of the activator valve permits the reopening sleeve to be pumped downwardly from its upper position to its lower position to force open the main valve. The reopening sleeve is disengaged from its lower position by independent upward movement of the main control sleeve. The main valve and the activator valve are both flapper valves and are both spring-biased closed. The garter spring does not cause snap action in this application, but rather serves as a releasable retainer on a secondary operator.

U.S. Pat. No. 3,070,119 ("Raulins"), U.S. Pat. No. 3,126,908 ("Dickens"), and U.S. Pat. No. 3,889,751 ("Peters") all disclose valves using latches for snap action. Raulins has a latch based on spring-loaded balls which act directly on the sealing poppet of the valve to provide snap action closure only. The sealing poppet of the valve is loaded by pressure drop across an integral internal flow beam. This load is supported by an annular array of balls which are spring-biased inwardly to engage a shoulder on the sealing poppet. The biasing load on the balls is provided by a very large axial force from an axially-acting coil spring bearing on a conically tapered ball support ring. The snap action is only in one direction and is actuated by forces applied to the sealing member, rather than an independent actuation mechanism.

The Peters apparatus is similar to that of Raulins, but the latch arrangements differ. Peters permits the sealing plug to move a limited amount prior to closing and uses axially translating balls that shift from one groove to another to release. Raulins permits substantially no sealing plug movement prior to latch release and does not use axially translating balls. The Dickens apparatus relies on an actuator with either a collet latch or ball latch released by movement to a disengagement groove under flow forces. A lost motion mechanism is required to link the actuator to the valve in order to accommodate the movement without affecting valve position. A very high axial bias force on the latch mechanism is required. The valve closing and opening require high flows to occur, so that reliable snap action is not a certainty with this device.

U.S. Pat. No. 4,160,484 discloses a flapper-type valve in which the flapper is biased to be normally closed, but is held open by a tube latched by a collet mechanism which releases at a predetermined load. The valve functions independently of the tube when the tube is not in position to paralyze the valve. The collet serves only to retain the tube in position and the latch does not provide for snap action.

All of the described devices either have a sealing plug directly loaded and held against closure until a predetermined release load is obtained or they rely upon a lost motion mechanism to effect closure. Not one of these devices has a reliable bi-directional snap action.

Thus, a need exists for a mudsaver valve that is less susceptible to abrasive wear to provide long life and reliability. In addition, a need exists for a mudsaver valve that can be adjusted to accomodate variations in mud weight and is short in length and easily assembled and disassembled.

SUMMARY OF THE INVENTION

The invention contemplates a simple device for solving the problems and disadvantages of the prior approaches discussed above. The mudsaver valve of the present invention provides a mechanism for a quick, automatically operating, snap acting opening and closing mechanism which is resistant to wear.

One aspect of the invention provides a reliable set of means for causing the combination of a valve operator and a valving member to exhibit bi-directional snap-acting behavior in the opening and closing actions of the combination.

Another aspect of the invention provides a reliable means of causing bi-directional snap-acting behavior in which the effecting bistable mechanism acts directly on the valving member.

A further aspect of the invention provides a means for inducing bi-directional snap-acting behavior in a valve operator and valve member combination in which the valving member is a rotary ball valve.

An additional aspect of the invention provides an automatic, full-opening, ball-type mudsaver valve with snap-acting opening action, as well as snap-acting closing action.

Yet another aspect of the invention provides a mudsaver valve which readily communicates drillstring pressure below the valve to above the valve without operator intervention.

A further aspect of the invention provides a mudsaver valve for which the sealing ball plug is automatically unseated in the event of very rapid mud pump pressure buildup or waterhammer, so that operating friction is reduced.

In addition, this invention provides a mudsaver valve which can be readily adjusted for changing mud densities.

Yet another aspect of the invention provides a mudsaver valve which is simple to assemble and disassemble under field conditions.

A further aspect of the invention provides a mudsaver valve, adapted for connecting a kelly or a top drive and a string of drill pipe, having a tubular valve body with a through bore flow passage, the body configured to connect to a drill string at its lower outlet end and to connect a kelly or a top drive at its upper inlet end. The mudsaver valve has a nontranslating rotatable ball with a through hole, where the ball is rotatable between a first and a second end position about coaxial central pivot pins journaled by a ball cage, such that when the ball is in the first position the ball through hole is aligned with the bore flow passage and when the ball is in the second position the ball through hole is misaligned with the bore flow passage to prevent flow through the valve. The valve has a valve seat that seals against the lower side of the ball and a dirt excluder that seals against the upper side of the ball. The valve has a reciprocable camming means for rotating the ball between the first and second end positions, a detent means that interacts with the ball to retain the ball in either end position until sufficient force is applied to the ball to overcome the interaction of the detent means with the ball, and an actuating means for displacing the camming means to rotate the ball, where the actuating means is responsive to valve inlet pressure on a first face and other forces on a second face that is obverse to said first face. Thus, when the actuating means applies sufficient force to the camming means to overcome the interaction of the detent means with the ball, the ball will rotate from one end position to the other end position.

The foregoing has outlined rather broadly several aspects of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed might be readily utilized as a basis for modifying or redesigning the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

The novel features which are believed to be characteristic of the invention, both as to its construction and methods of operation, together with the objects and advantages thereof, will be better understood from the following description taken in conjunction with the accompanying drawings, wherein.

DETAILED DESCRIPTION OF THE INVENTION

Figure 1A:
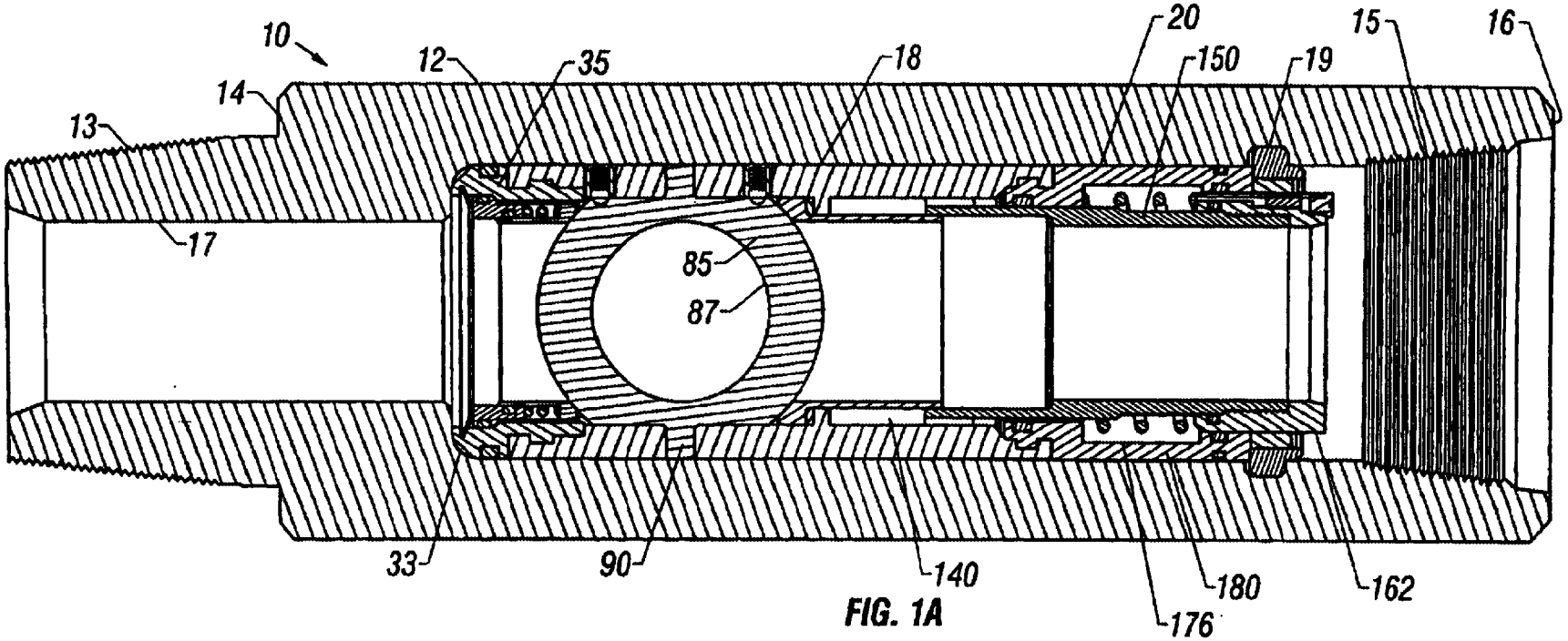
FIG. 1A shows a longitudinal section of the first embodiment of the mudsaver valve in its closed position.

The present invention provides a mudsaver valve with an adjustable bi-directional snap action for opening and closing the valve. The mudsaver valve of the present invention provides a mechanism for communicating drillstring pressure below the valve to above the valve without operator intervention and means for automatically unseating the sealing ball plug in the event of very rapid mud pump pressure buildup in order to reduce opening friction. The mudsaver valve of the present invention is simple to assemble and disassemble under field conditions due to its cartridge construction and has an improved reliability and life span.

Referring now to the drawings, it is pointed out that like reference characters designate like or similar parts throughout the drawings. The Figures, or drawings, are not intended to be to scale. For example, purely for the sake of greater clarity in the drawings, wall thickness and spacing are not dimensioned as they actually exist in the assembled embodiment. For clarity, up is used to refer to the pump inlet side of the valve and is shown on the right hand side of all side views and longitudinal sections.

FIG. 1A shows a longitudinal section of one embodiment of a mudsaver valve 10. The parts of the mudsaver valve 10 are fabricated of a suitable material such as alloy steel or stainless steel. The body 12 of the valve 10 is configured to be attached to a oilfield drillstring immediately below the kelly or top drive of the drilling rig.

Body 12 is a generally cylindrical pressure-containing tube with male threads 13 and sealing face 14 on its lower end for engaging the upper end of the drillstring and female threads 15 and sealing face 16 on its upper end for engaging the lower end of the kelly or top drive of the rig. A lower concentric bore 17 conveys fluid flowing out of the valve, while a central bore 18 houses a preassembled valve cartridge 20 shown in FIG. 2.

Figure 3:
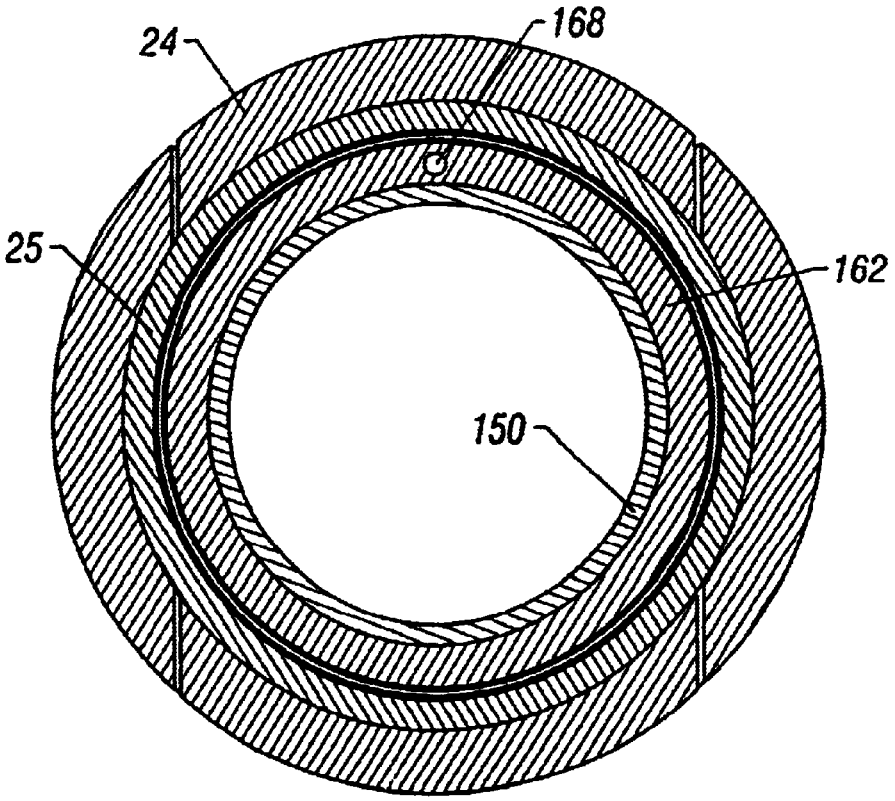
FIG. 3 is a transverse sectional view taken along section line 3—3 of FIG. 2.
Figure 11:
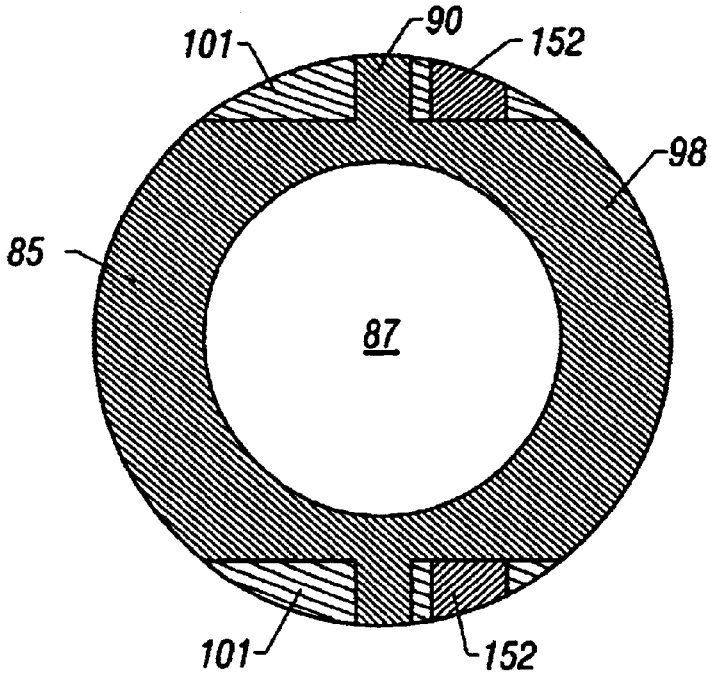
FIG. 11 is a transverse cross-section of the valve cartridge taken along section 11—11 of FIG. 5.

Internal recess groove section 19 located between central bore 18 and upper end female thread 15 provides a shoulder for engaging the upper end of cartridge 20. The upper end of cartridge 20 is shown in more detail in FIG. 11B. The upper end of cartridge 20 has a segmented locking ring 24, a backup ring 25, and an entrapping snap ring 26. FIG. 3 shows a cross section of the upper end of the cartridge. The segments of locking ring 24 have an outer diameter larger than the central bore 18, but sized to engage the groove 19. The snap ring 26 snaps into the groove 27 provided on the upper end of the inner bore of locking rings 24. The segmented locking rings 24 are installed and removed through the throat of female thread 15. The outer diameter of backup ring 25 entraps the segments of locking ring 24 by abutting their inner bore faces to engage groove 19. Thus, the backup ring 25 prevents the inward collapse of segmented locking rings 24. Shoulder 22 or locking ring 25 engage groove 18 of body 12 to entrap the valve cartridge 20 within the body 12.

Figure 1B:
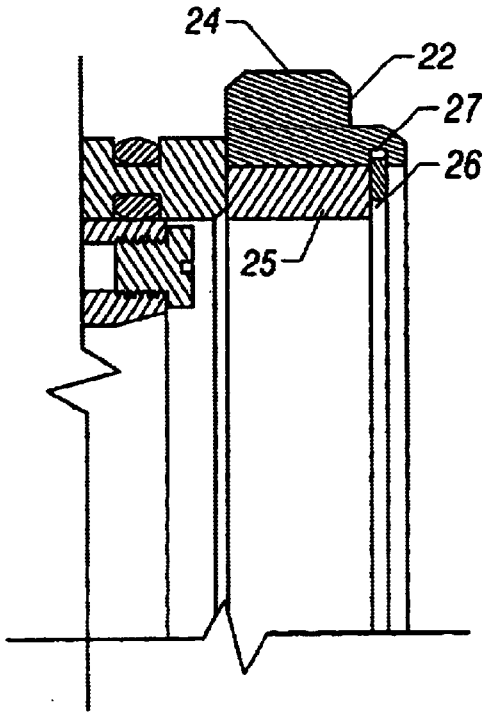
FIG. 1B is a blow-up of a longitudinal half sectional view of the upper end of the valve cartridge of FIG. 1A showing the retention means for holding the valve internals in the body.
Figure 1C:
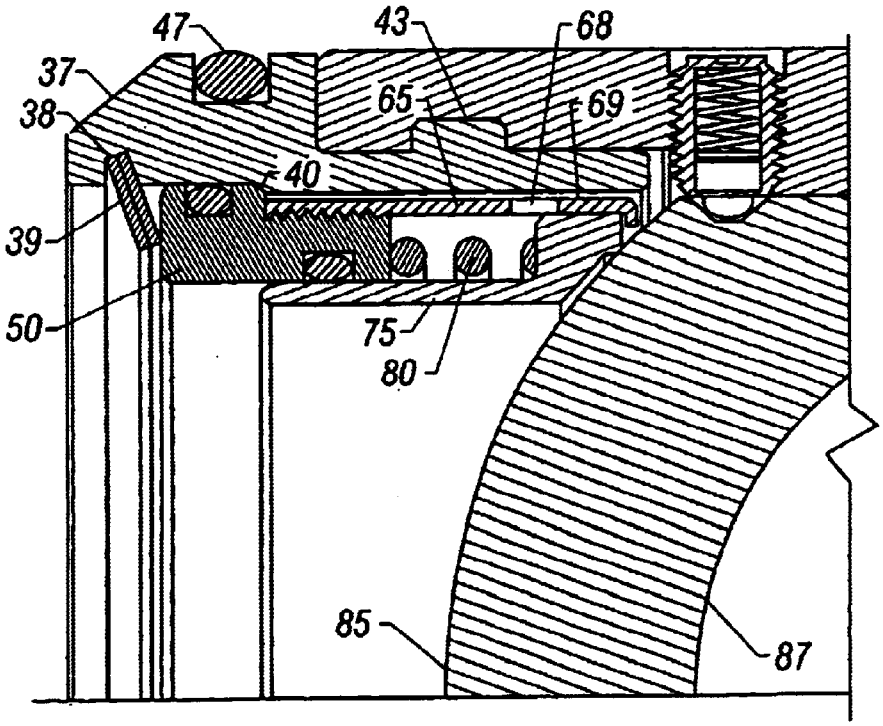
FIG. 1C is a blow-up of a longitudinal half sectional view of the lower end of the valve cartridge of FIG. 1A showing the seat assembly in its normal position bearing against the ball.

The lower end of cartridge 20 abuts shoulder 33 at the lower end of the mudsaver valve 10. FIG. 1C more clearly shows the details of the valve seating arrangement in the description immediately following. Seat holder 37 has a transverse lower face which rests against body shoulder 33, a first cylindrical counterbore with groove 38 for a conically-dished snap-ring 39 positioned therein, an adjoining and somewhat smaller diameter second cylindrical counterbore with a conical abutment transition shoulder 40 positioned between the first and second counterbores.

The outer diameter of seat holder 37 closely fits within the central bore 18 of valve body 12 and has a large bevel where it abuts the abutment shoulder 33. The outer diameter of seat holder 37 is reduced on its upper end and has an annular ridge 43 positioned in the reduced diameter section. The lower transverse face of annular ridge 43 provides a shoulder for engaging other segments of the valve. A male O-ring groove containing O-ring 47 is positioned on the outer diameter of the first cylindrical couterbore. Other valve components found at the lower end of cartridge 20 are a seat biasing piston 50, a seat travel limiter 65 and a seat 75 biased by spring 80. These components are shown in more detail in FIGS. 4A and 4B.

Figure 4A:
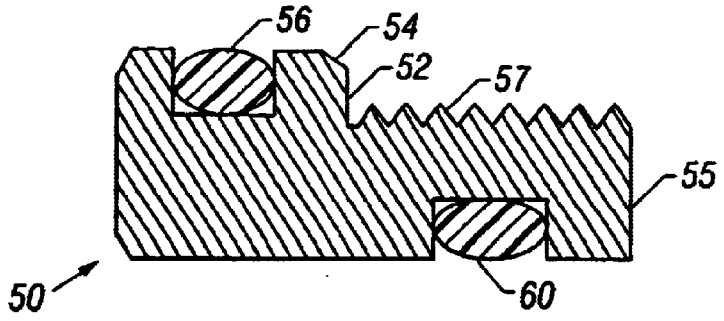
FIG. 4A shows a longitudinal sectional view of the seat biasing piston.
Figure 14:
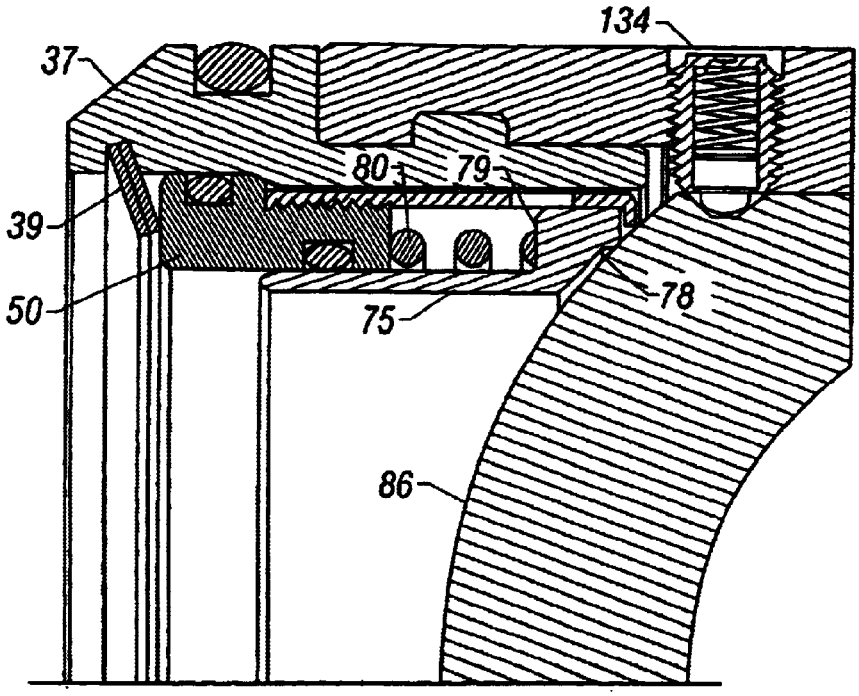
FIG. 14 is an enlarged detail of the seat portion of the longitudinal section of FIG. 1, showing the seat sealing against the closed ball.

FIGS. 1C, 4A and 14 show the annular seat biasing piston 50 and its interaction with seat holder 37. The piston 50 has a stepped cylindrical outer wall with a threaded small diameter cylindrical section, an enlarged diameter cylindrical section, and transverse transition shoulder 52 therebetween. Conical chamber 54 between transition shoulder 52 and the enlarged outer cylindrical section is adapted to abut against comating transition shoulder 40 of seat holder 37. Seat biasing piston 50 has a male O-ring groove, containing O-ring 56, on its enlarged outer diameter section to sealingly engage the counterbore of seat holder 37. The smaller cylindrical section has a male thread 57 on its outer surface.

The lower transverse face of seat biasing piston 50 provides a reaction shoulder for biasing forces applied by conically-dished snap ring 39 as seen in FIG. 1C, which functions much like a Belleville spring. The snap ring 39 is mounted in snap-ring groove 38 of seat holder 37 and provides an upward biasing force on seat biasing piston 50. Seat biasing piston 50 is reciprocable within first cylindrical counterbore of seat holder 37. The inner bore of seat biasing piston 50 has female O-ring groove, containing O-ring 60, located intermediately along its length to sealingly engage the seat 75. Upper transverse end shoulder 55 of piston 50 connects the interior bore cylindrical face of seat biasing piston 50 to the seat travel limiter 65. Upward travel of seat biasing piston 50 under the biasing force provided by biasing snap ring 39 is limited by conical shoulder 40 of seat holder 37. Area A1, the effective differential piston area of seat biasing piston 50, is that transverse cross-sectional area contained between the enlarged diameter cylindrical section and the inner bore.

Figure 4B:
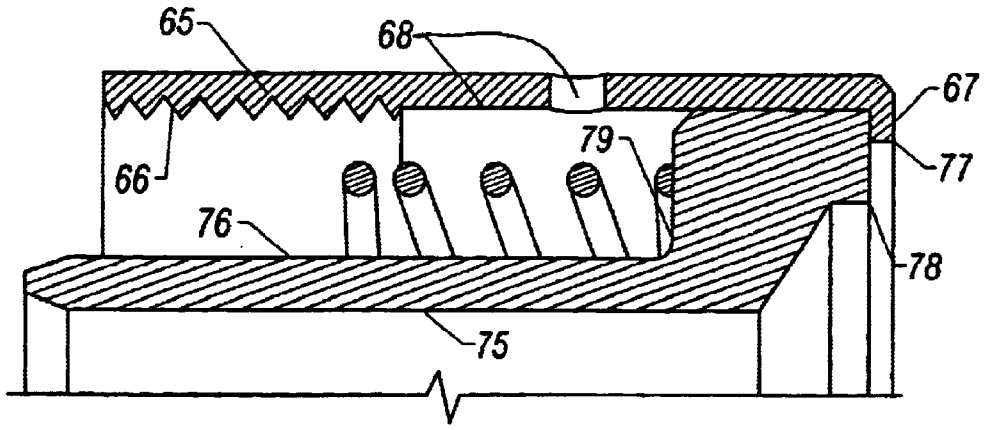
FIG. 4B shows a longitudinal sectional view of the valve seat and the seat travel limiter.

Seat travel limiter 65, shown in FIG. 4B, has a thin annular wall with a female thread 66 on its inner, lower end for engagement with the male threads 57 on the smaller outer cylindrical face of seat biasing piston 50. At the upper end of travel limiter 65 is transverse lip 67 projecting inwardly. Multiple holes 68 are positioned at approximately midlength of travel limiter 65 to provide fluid communication between its inner and outer cylindrical faces. An annular gap 69, as seen in FIG. 1C, is provided between the outer diameter of travel limiter 65 and the second counterbore of seat holder 37 to permit fluid pressure communication to holes 68.

Seat 75 has annular stepped cylindrical construction with a straight bore, smaller outer diameter cylindrical face 76, and an enlarged diameter cylindrical upper head. The bore provides a portion of the main flow passage through valve 10. The bore and smaller outer diameter cylindrical face 76 define a thin-walled lower end, while the upper transverse face 77 and stepped conical relief of the upper head form an annular line-contact sealing ridge 78. Lower transverse face 79 of the upper head provides a reaction face for application of spring bias to seat 75. A seat annular differential piston area A2 is defined between the diameter of smaller cylindrical surface 76 and the diameter of sealing ridge 78. Seat bias coil compression spring 80 reacts against lower transverse face 79 of seat upper head 75 and transverse upper shoulder 55 of seat biasing piston 50. The force exerted and spring rate of spring 80 are less than those of snap ring 39.

Figure 2:
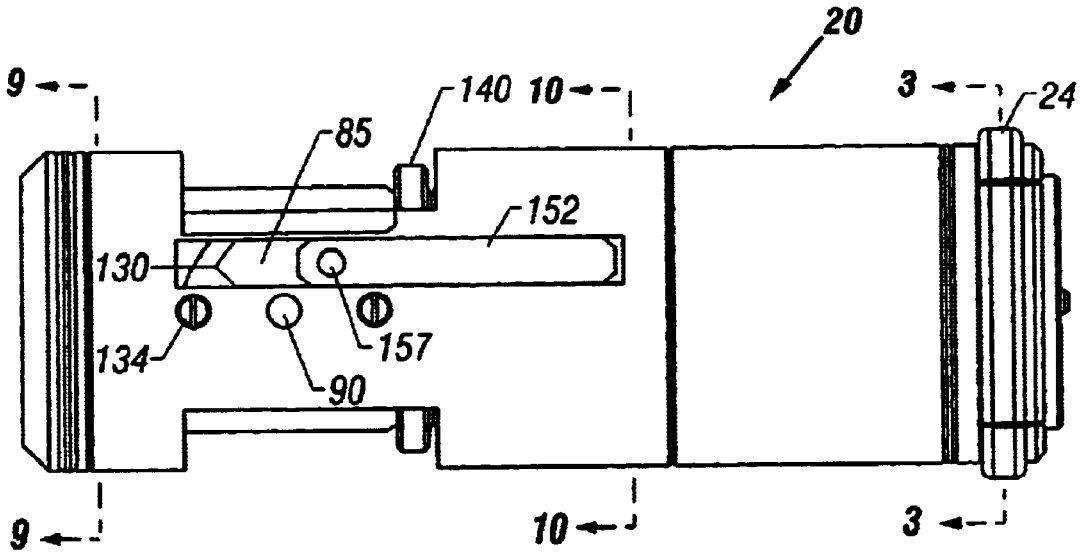
FIG. 2 shows a side view of the valve cartridge in its closed position.
Figure 5:
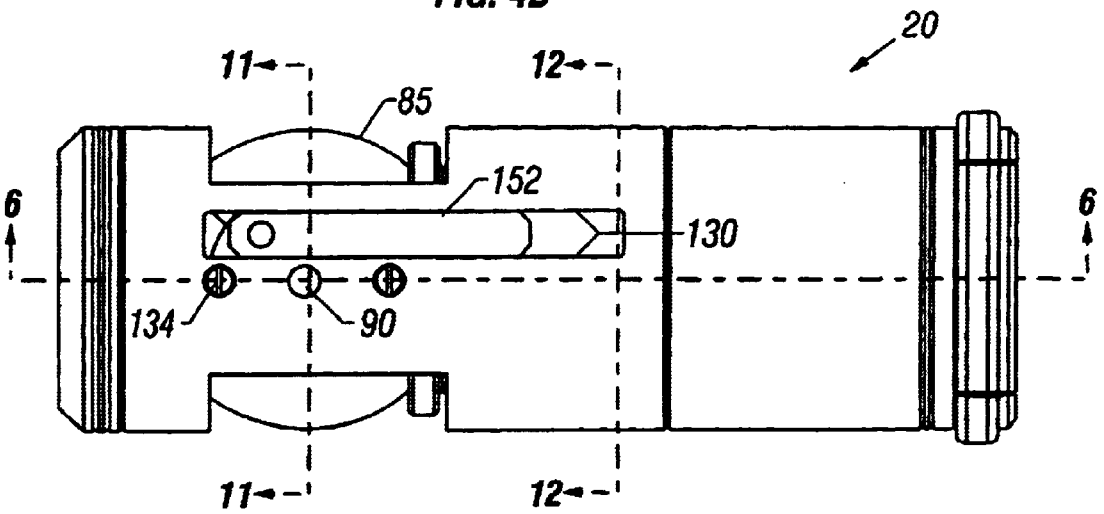
FIG. 5 shows a side view of the valve cartridge in its open position.
Figure 8:
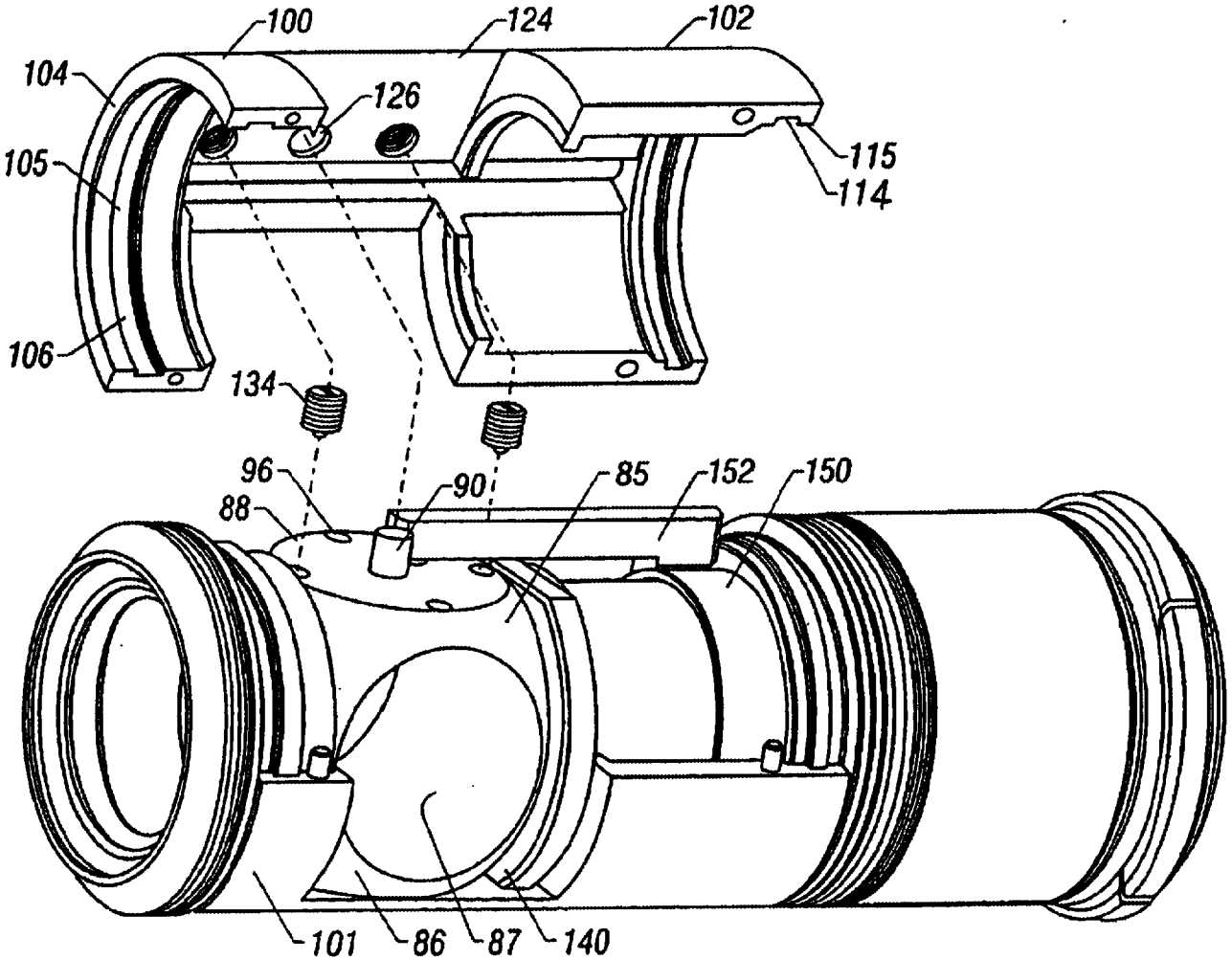
FIG. 8 is a partially exploded view of the valve cartridge.

Turning now to FIGS. 6 and 8, ball 85 has a generally spherical outer surface 86, a cylindrical through flow passage 87, and mirror-image opposed flat faces 88 equispaced from the axis of the through flow passage 87. The valve assembly operates by moving flow passage 87 into or out of alignment with the central flow passage of valve 10. In FIGS. 1 and 2 the flow passage 87 is out of alignment with the central flow passage and the valve is closed. In FIGS. 5 and 6 the flow passage 87 is in alignment with the central flow passage and the valve is open.

Figure 7:
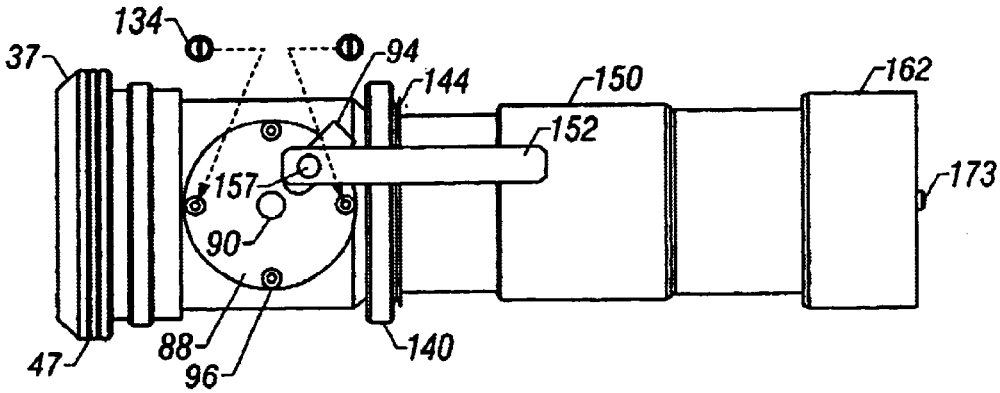
FIG. 7 is an external view of the valve cartridge interior elements without some of the outer elements shown, corresponding to FIG. 5, showing the configuration of the flat face of the ball and the camming actuator.

Central to each of the flat faces 88 are concentric coaxial projecting cylindrical pins 90, with axes perpendicular to the flat faces 88 and the axis of the flow passage 87. Ball 85 is configured to rotate in a trunnion mount about its pins 90. Mirror-image camming grooves 94, as shown in FIG. 7, are provided in faces 88. Camming grooves 94 are both parallel to faces 88 and inclined at an angle of 45° to the axis of flow passage 87. Multiple detents 96 are located 90° apart in a circular array around ball pin 90 on face 88 of ball 85. Two detents are coplanar with the axis of the ball through hole 87 and the rotational axis of ball 85 defined by pins 90; the other two detents are in a plane perpendicular to that axis and through the rotation axis of ball 85.

Figure 6A:
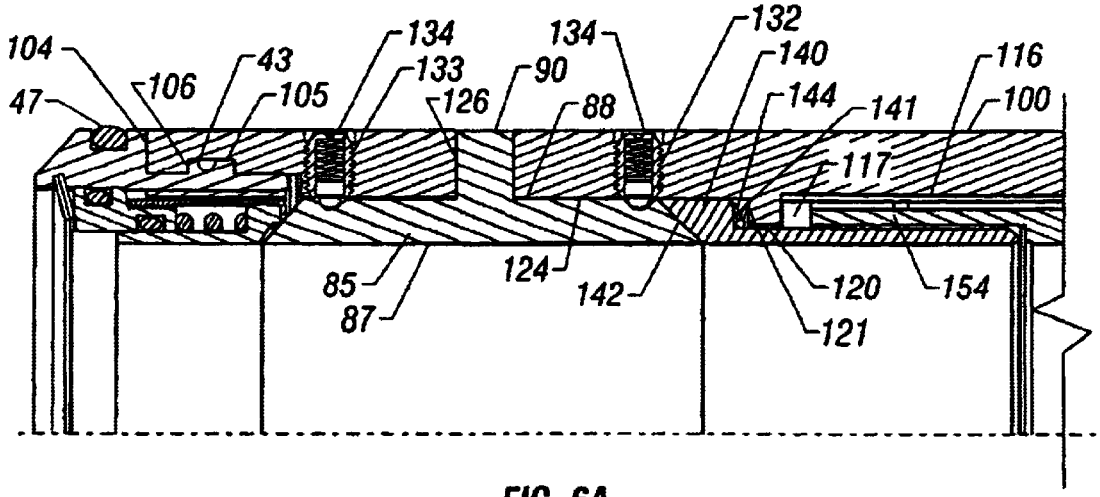
FIG. 6 (broken apart for clarity into FIG. 6A and FIG. 6B) is a longitudinal half section along section line 6—6 of FIG. 5.
Figure 6B:
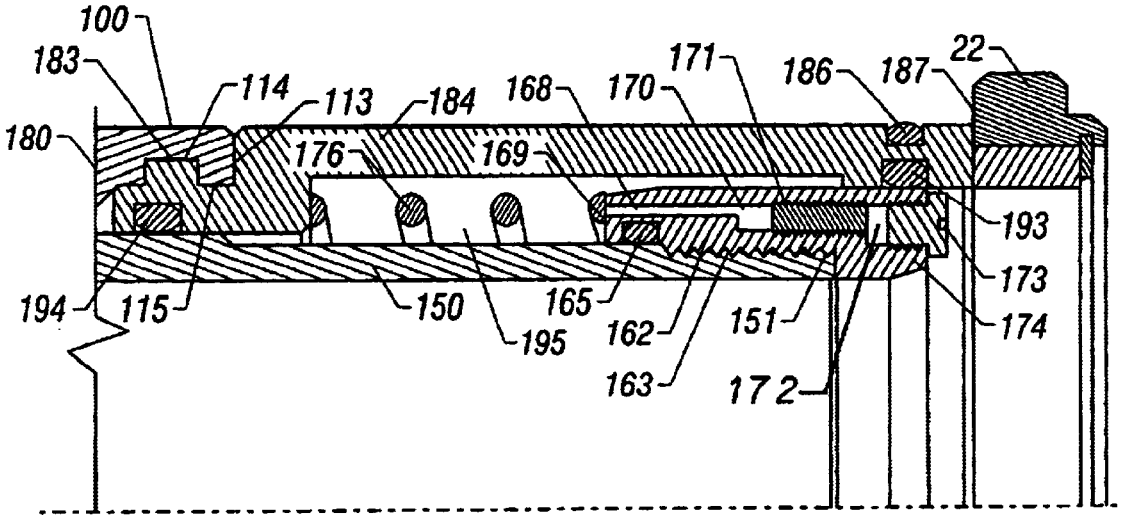

Mirror-image split ball cage halves 100 and 101 provide support for the rotatable ball 85 as shown in FIG. 8. Because of general anti-symmetry between ball cage halves 100 and 101, only upper half ball cage 100 will be described. The upper half ball cage 100 has a generally half-cylindrical outer surface 102 which closely fits inside central bore 18 of the valve body 12. The interior surface of the lower end of cage half 100, as seen in FIG. 6B, is an annular half-ring with lower transverse face 104 and interior annular groove 105 having transverse lower shoulder 106.

Figure 9:
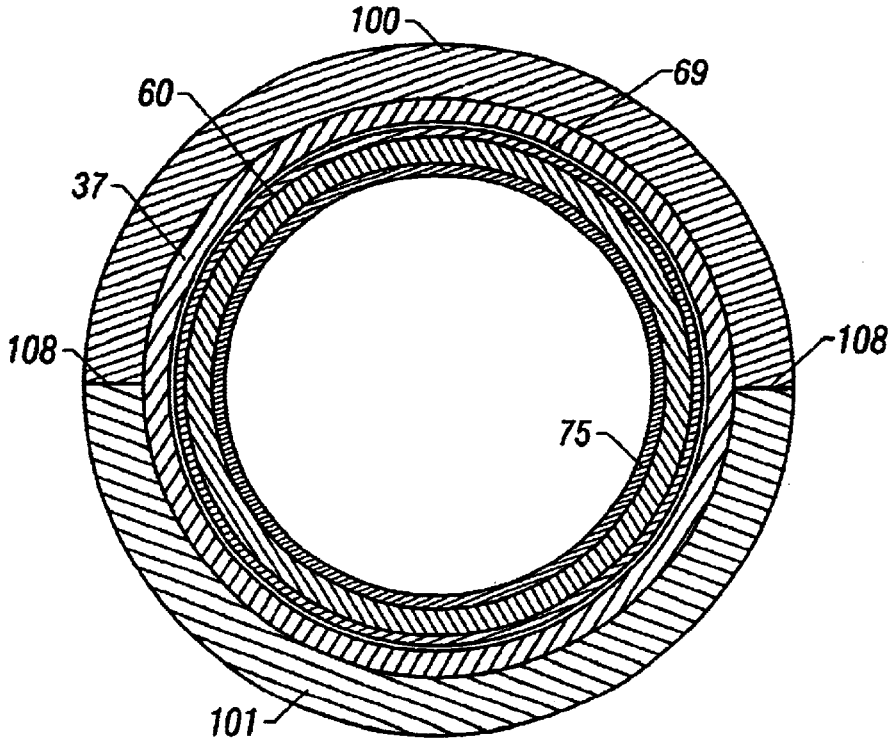
FIG. 9 shows a cross-sectional view of the valve cartridge taken along section line 9—9 of FIG. 2.

Groove 105 mates with annular ridge 43 of seat holder 37 so that the seat holder 37 and upper ball cage 100 are keyed together when entrapped within central bore 18 of valve body 10. FIG. 9 shows how the diametrically-cut ends 108 of the lower end of cage half 100 comates on a diametral plane with opposed similar ends on lower ball cage 101 in order to establish close control of the interrelationship of the mirror-image features of the two ball cage halves 100 and 101.

Figure 10:
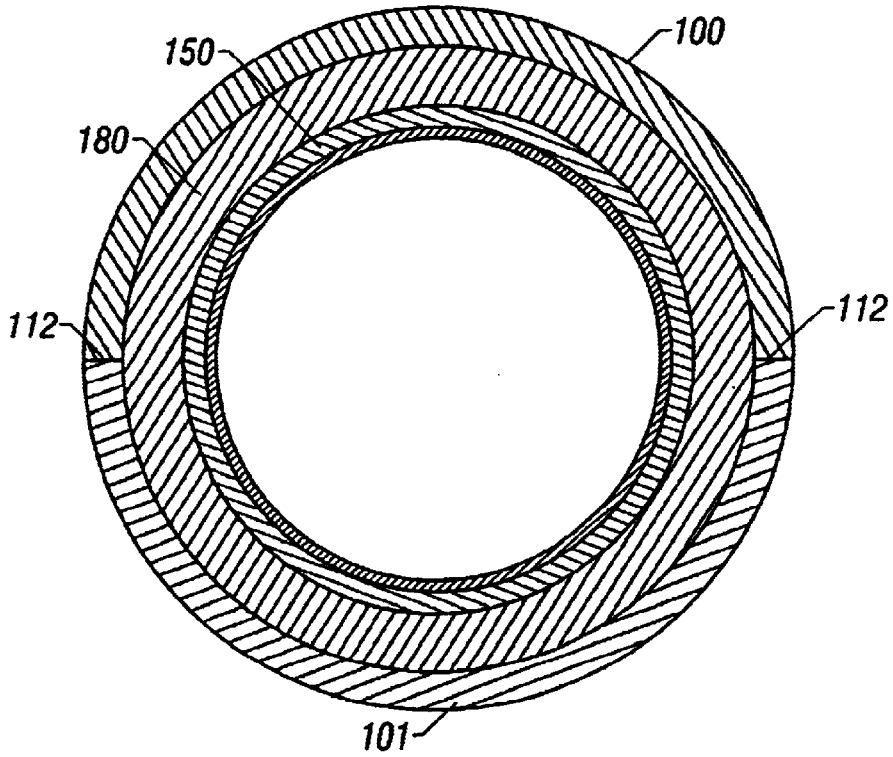
FIG. 10 shows a cross-sectional view of the valve cartridge taken along section line 10—10 of FIG. 2.

Referring to FIGS. 6 and 8, the top end on the inner surface of upper ball cage half 100 has an annular half-ring with an upper traverse face 113 and an interior annular groove 114 in its largest inner diameter upper cylindrical face 115. Diametrically-cut ends 112 of annular upper face 113 comate and abut similar ring ends of the lower half ball cage 101 as shown in FIG. 10. Diametrically-cut ends 108 and 112 are coplanar.

Intermediate diameter cylindrical bore 116 of ball cage half 100 defines the outer side of a half-cylindrical annular cavity 117. The lower side of annular cavity 117 is defined by an annular ridge 120 facing inward. This annular ridge 120 has a lower transverse face 121 that provides a reaction shoulder for at least one spring 144. Spring 144, reacting against faces 141 of dirt excluder 140 and traverse face 121 of upper half ball cage 100 and the corresponding face of lower fall cage 101, may be a set of Bellville washers or other known spring type.

Intermediate to the length of upper ball cage 100, parallel to the diametral plane of ends 108 and 112, and configured to fit closely to flat 88 of ball 85 is planar surface 124. Surface 124 extends downwardly from transverse face 121 to the bottom end of cage half 100, providing clearance and support for the ball 85 and clearance for the dirt excluder 140. The portion of upper half ball cage 100 between outer cylindrical surface 102 and planar surface 124 also provides structural support for the valve elements engaged with grooves 105 and 114.

A central through hole 126 is positioned perpendicular to planar surface 124 with its axis coaxial with the longitudinal axis of the valve 10 journal pins 90 of ball 85 so that the ball is rotatable about its axis perpendicular to the longitudinal axis of the valve 10.

Returning to FIGS. 2 and 5, elongated slot 130 is symmetrical about the valve midplane through ball cage ends 108 and 112 and centered about a plane which is normal to the diametral plane of ends 108 and 112 and parallel to the longitudinal axis of the valve 10, but displaced laterally from the rotational axis provided by central through hole 126. The sides of slot 130 are perpendicular to the diametral plane of ends 108 and 112 and the projection of the slot on said diametral plane is rectangular.

Drilled and tapped holes 132 and 133 are located in the plane defined by the axis of central through hole 126 and the longitudinal axis of valve 10. One or more commercially available threaded-body spring plungers or ball plungers 134, such as those shown in the Carr Lane Manufacturing Co. 1998 Catalog Component Parts of Jigs and Fixtures as items CL-70-SPS-1 or CL-70-SBP-3, are mounted in tapped holes 132 and 133 such as to engage ball detents 96 when the ball 85 is rotated into a suitable position. As shown in FIG. 6A, two spring plungers 134 on the upper half ball cage 100 are used in this embodiment. Although not shown in FIG. 6A, lower half ball cage 101 is not provided with plungers, but may optionally be so provided.

Dirt excluder 140, as shown in FIG. 6A, is reciprocably housed within the top end of the interior of the upper and lower half ball cages 100 and 101. Dirt excluder 140 has a straight through bore which serves as a portion of the main flow passage through the valve 10, an elongated thin-walled cylindrical upper body, and an upset head with transverse upper face 141 and spherical lower face 142 which mates with spherical face 86 of ball 85. Spring 144 is positioned between upper transverse face 141 of dirt excluder 140 and lower transverse face 121 of upper half ball cage 100 and the corresponding face of lower half ball cage 101. Spring 144 biases spherical lower face 142 of dirt excluder 140 against surface 86 of ball 85 to effect a seal at their interface. Different types of biasing spring may be used such as a helical spring or, as shown, a set of Belleville spring washers.

Camming arm unit consists of a tubular body 150 with external threads 151 at its top end and mirror-image projecting camming arms 152 extending downwardly parallel to a diametral plane through the longitudinal axis, but offset from said axis. This can best be seen in FIGS. 7, 11 and 12. Camming arm unit is reciprocable within the half ball cages 100 and 101.

The interior surface of the top end of the tubular body 150 of the camming arm unit serves as a portion of the primary fluid passageway through the valve 10. The bottom portion of the tubular body bore 154 is enlarged in order to clear the upper end of dirt excluder 140 and provide a narrow annular flow passage between bore 154 and the exterior of dirt excluder 140.

Figure 12:
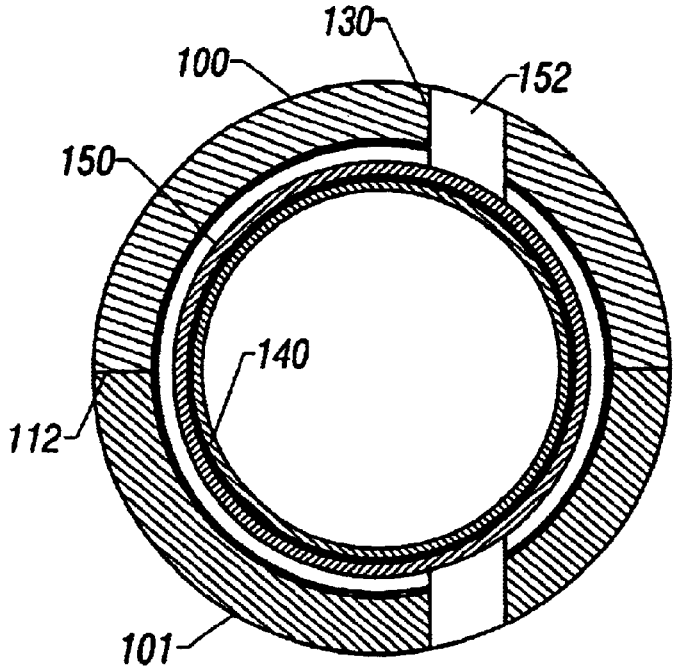
FIG. 12 is a transverse cross-section of the valve cartridge taken along section 12—12 of FIG. 5.

The exterior of the tubular body 150 of the camming arm unit has two different outer diameters below the threaded top end. The second, larger outer diameter section has outwardly extending projections to which the offset parallel camming arms 152 are mounted as shown in FIGS. 8 and 12. The planar first inner faces of the camming arms are equispaced from the plane of symmetry of the camming arms 152 and clear the flat face 88 of ball 85. The external faces of the camming arms 152 obverse to the first inner faces are cylindrical. The planar second inner faces and their obverse outer sides are normal to the first inner faces adjacent the flats 88 of ball 85.

Near the bottom end of the camming arms 152 are coaxial pin-mounting holes which are located in the offset plane of the camming arms. Stepped cylindrical camming pins 157 have their smaller diameter press-fitted into the pin-mounting holes. The larger ends of the camming pins 157 are positioned on the inner side of camming arms 152 and engage the mirror-image camming grooves 94 of ball 85. The camming arms 152 can reciprocate in the slot 130 of upper half ball cage 100 and the mirror-image lower ball cage 101 whenever the camming arm unit, composed of the tubular body 150 and camming arms 152, is reciprocated within the bore of the half ball cages. Because the pins 90 of ball 85 are journaled in central through hole 126 of upper half ball cage 100 and the corresponding hole in lower half ball cage 101, off-center forces imparted from camming pins 157 to the camming grooves 94 of the ball 85 will tend to cause ball 85 to rotate about its journaled axis. Downward forces applied to the camming arm unit will tend to open the ball 85, while upward forces will tend to close the ball.

Annular piston 162 is coaxially attached by interior female screw threads 163 to the male threads 151 of the top end of camming tubular body 150. An internal shoulder of piston 162 abuts the top end of camming arm unit 150 to serve as a travel stop during thread make-up. A female O-ring groove is located below threads 163 and contains O-ring 165. O-ring 165 seals between the interior bore of piston 162 and the unthreaded upper portion of camming arm unit 150. The moving seal surface for the piston 162 is its outside cylindrical surface. The upper transverse face of piston 162 is exposed to the mud pressure from hydrostatic pressure or combined pump and hydrostatic pressure. A through hole 168 is drilled parallel to the flow axis for valve 10 through the body of piston 162, emerging on lower transverse face 169 of piston 162. Another larger tapped hole 170, intersecting through hole 168, is bored partially through the piston body on an axis parallel to that of hole 168, but slightly offset from hole 168.

A Schrader valve 171 of the type commonly used as a fill valve for air-conditioning systems or tires is screwed into the internal threads provided in the bore of hole 170. Schrader valve 171 seals against the walls of hole 170, thus controlling admission of fluid or gas to and from the region below piston 162. An upper hole 172 is provided that is larger, yet shallower, than hole 170. Upper hole 172 is parallel to and intersects hole 170. Hole 172 is provided with female threads which comate with the male threads of seal screw 173 which is installed in hole 172 in order to selectably fully isolate Schrader valve 171.

Upper transverse face 174 of piston 162 is thus connected to lower transverse face 169 by the flow path constituted by intersecting holes 168, 170, and 172. Flow is controlled through this flow path by Schrader valve 171, while selectively removable seal screw 173 prevents flow access to Schrader valve 171 when installed. Piston bias coil compression spring 176, located adjacent the upper cylindrical outer surface of camming tubular body 150, bears against lower transverse face 169 of piston 162 in order to urge the piston upwardly.

Reference chamber 180 is located exterior to and coaxial with camming tubular body 150 and piston 162. On the lower end, reference chamber 180 has two reduced diameter external cylindrical sections which have annular transverse ridge 183 positioned therebetween. Annular ridge 183 is configured to engage annular internal groove 114 of upper half ball cage 100 and the corresponding groove of mirror-image lower half ball cage 101.

Larger external cylindrical surface 184 closely fits to the central bore 18 of the body 12 of valve 10. Cylindrical surface 184 has a male O-ring groove located near its upper end, with O-ring 186 mounted therein. Transverse upper shoulder 187 abuts shoulder 22 of the segmented locking rings 24 so that the internals of valve 10 are retained within valve body 12.

The interior of reference chamber 180 has an upper end first cylindrical section with a female O-ring groove having an O-ring 193, an enlarged bore intermediate cylindrical section, and a reduced diameter cylindrical section with a female O-ring groove and O-ring 194 positioned therein at the lower end. O-ring 194 seals against the the external cylindrical surface at the upper end of camming tubular body 150. The annular space in between reference chamber 180, piston 162, and camming tubular body 150 between O-rings 193 and 194 constitutes a pressure-containing chamber 195 to which the piston 162 is exposed on its lower transverse face 169. This chamber can be selectively pre-charged through Schrader valve 171 mounted in piston 162 whenever seal screw 173 is removed. Piston bias spring 176 is located within chamber 195 and bears against the lower interior transverse face of reference chamber 180. Chamber 195 is pressure-isolated by O-rings 193, 194, and 165 and seal screw 173.

The internal components of the valve that fit into the valve body 12 are handled as a cartridge assembly with the exception of segmented locking rings 24, backup ring 25, and snap ring 26. This is because annular grooves 105 and 114 of upper half ball cage 100 and the corresponding grooves of lower half ball cage 101 engage annular ridges 43 of seat holder 137 and 183 of reference chamber 180 to effectively hold the valve internals together axially. Whenever the internals are inserted into intermediate bore 18 of valve body 12, then the cartridge is completely restrained on its outer diameter. Segmented locking rings 24 can then be inserted into groove 19 of body 12, backup ring 25 inserted interior to the segmented locking rings, and then snap ring 26 inserted into the snap ring groove on the upper interior cylindrical face of the segmented rings. In this manner, the valve internals are additionally fully constrained to stay between lower internal transverse shoulder 33 of body 12 and the locking rings 24.

Figure 13A:
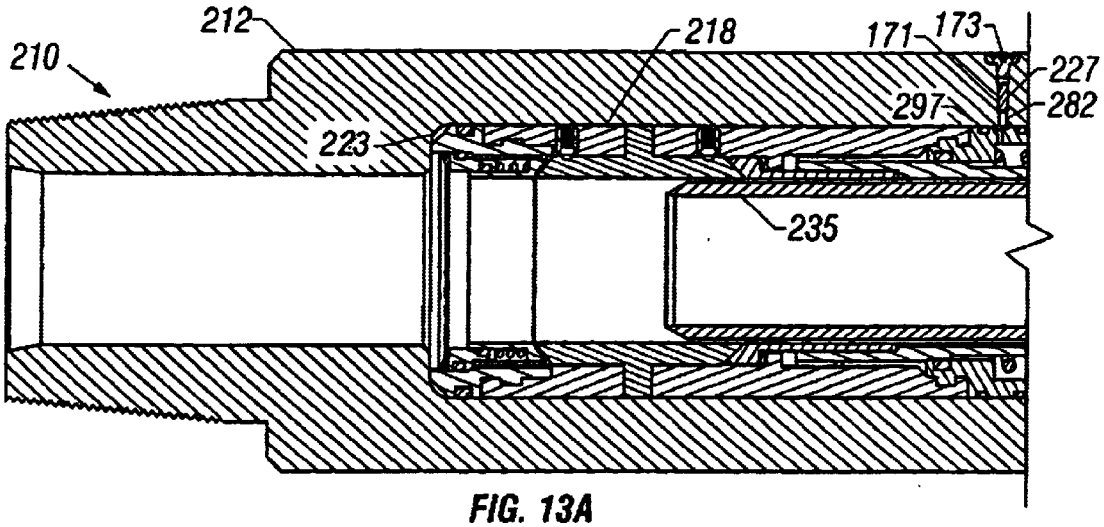
FIG. 13 (broken apart for clarity into FIG. 13A and FIG. 13B) is a longitudinal section of the second embodiment of the mudsaver valve in its locked-open position.
Figure 13B:
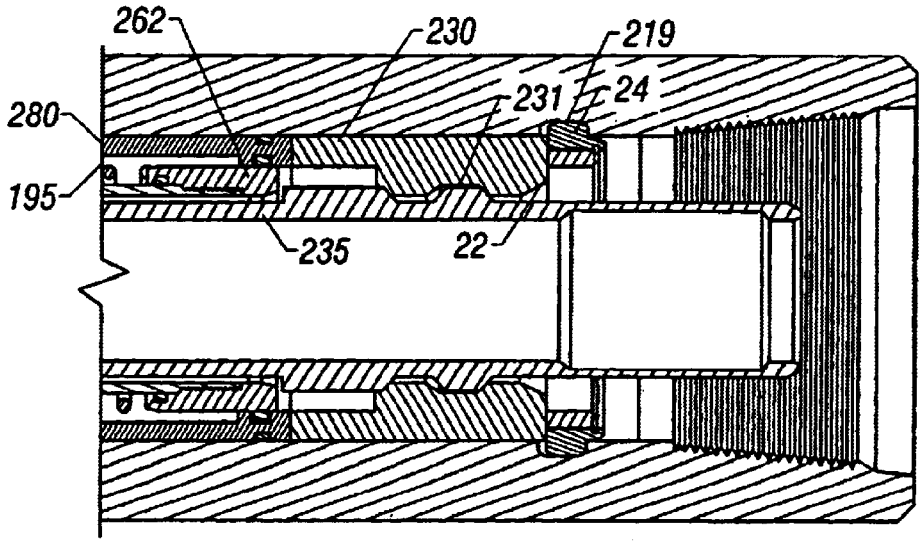

FIGS. 13A and 13B show a second embodiment 210 of the valve which is suitable for locking the valve open to permit wireline operations through the valve to free pipe that has been stuck below the rig floor. This embodiment is substantially similar to the first embodiment of the valve discussed above and uses many of the same internal components.

One difference between the first and second embodiment is that the intermediate bore 218 of body 212 is elongated between interior transverse abutment shoulder 223 and internal recess groove 219 which engages the segmented locking rings 24 The additional length is used to accommodate latch sleeve 230 which is positioned between the upper transverse shoulder of the reference chamber 280 and the lower transverse face 22 of segmented locking rings 24. Latch sleeve 230 has a constant outer diameter which closely fits bore 218 of body 212. The interior of latch sleeve 230 has a lead-in chamfer and at least one interior groove 231. The internal groove 231 is used to locate and engage a latchable/retrievable wireline-run lock-open sleeve tool such as the device shown in U.S. Pat. No. 4,220,176 or other commercially available devices.

A lock-open sleeve device 235 latched into position is shown as an integral entity without details of its selectably operable latching and retrieval mechanisms. Such devices are known in the downhole tooling art. Piston 262 is the same as that used for the first embodiment shown in FIG. 6B, but the series of holes 168, 170 and 172 containing the Schrader valve 171 and seal screw 173 are removed.

Valve body 212 has radial port 227 into which Schrader valve 171 is pressed or threadedly mounted in a manner similar to that of the first embodiment of the valve. The outer end of radial port 227 is threaded to accommodate seal screw 173, which seals the outer end of Schrader valve 171 from external pressure. The extreme outer end of radial port 227 is countersunk in order to protect the head of seal screw 173. For the embodiment of FIGS. 13A and 13B, reference chamber 280 contents are accessed through radial port 282, which is axially positioned close to the location of radial port 227 in valve body 212.

Two male O-ring grooves, containing O-rings 297, are located straddling a recess at the exterior end of radial port 282 in reference chamber 280. O-rings 297 seal the annular gap between bore 218 and reference chamber 280 to ensure that the fluid path formed by radial port 227 of body 212 and radial port 282 of reference chamber 280 is isolated from the interior flow passages of valve 210. This permits pressure-containing chamber 195 to be selectively precharged through Schrader valve 171 whenever seal screw 173 is removed.

O-rings 186 and 47 prevent fluid passage around the outside of the valve internals. O-rings 56 and 62 prevent fluid passage around the seat biasing piston 50 and the seat 75. Seat 75 is generally engaged against ball 85 except for the special conditions discussed in the description of the seat operation given below.

Figure 15:
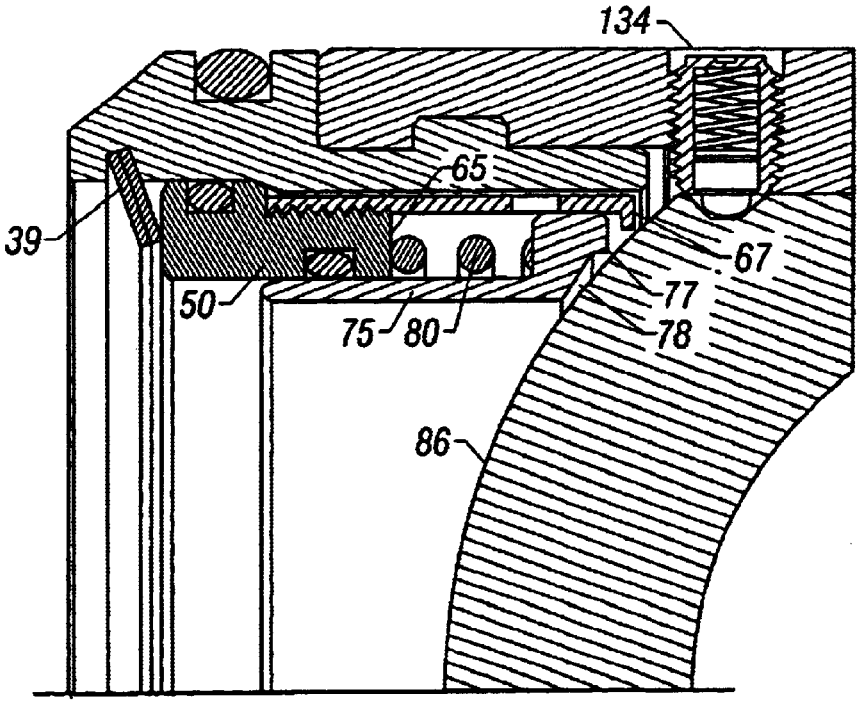
FIG. 15 corresponds to FIG. 12, but with elevated pressure from below the ball causing the seat to lift off the ball surface.
Figure 16:
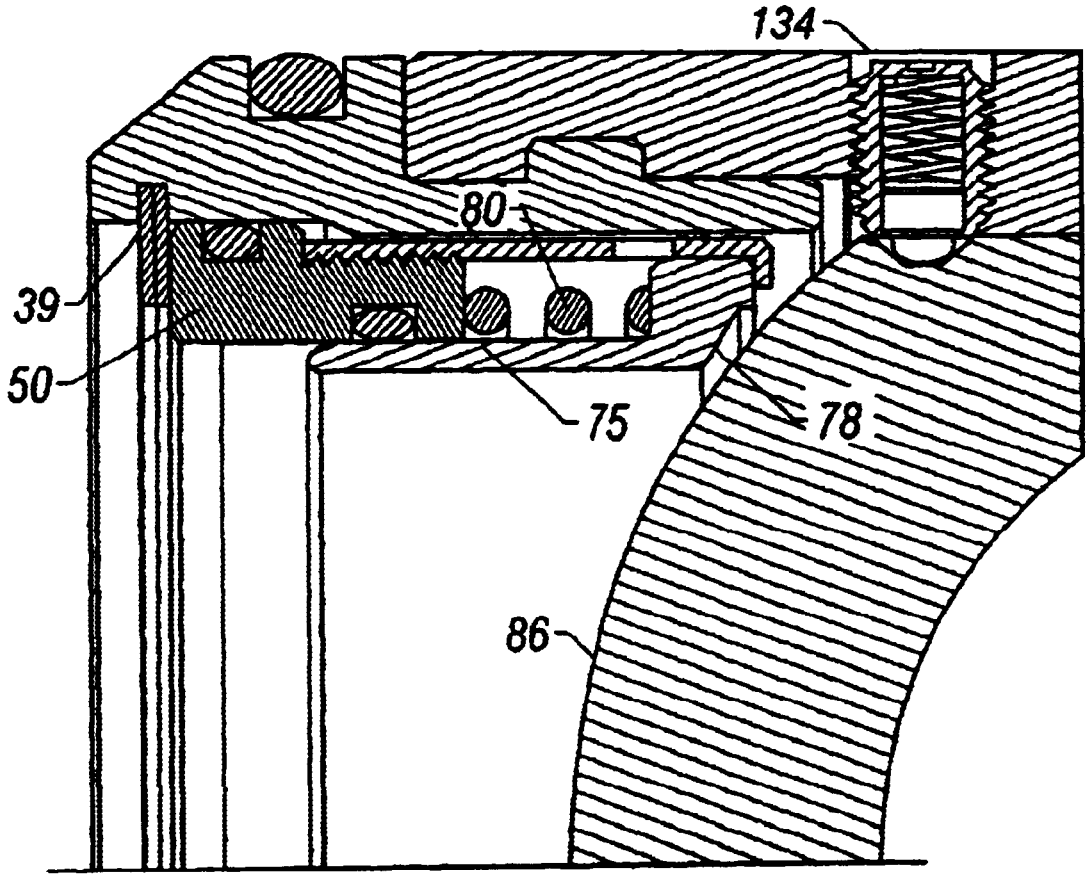
FIG. 16 corresponds to FIG. 12, but with the seat biasing piston retracted so that the seat does not seal against the ball, as occurs with a pressure surge from above the ball.

FIGS. 14–16 show the configuration of the valve seating arrangement for each of the three operating modes of the closed valve. The same valve seating arrangement is used in all embodiments of this invention. For FIG. 14, the configuration of the valve shown is that assumed when the valve is disconnected from the drillstring and the mud column above the valve is being retained. The seat 75 is shown in sealing engagement with ball 85 in this case.

In FIG. 15, the configuration of the valve is for the case when there is a substantial net pressure retained in the connected drillstring below the closed ball. For this case, the seat 75 is forced away from the closed ball so that pressure communication is established between spaces below and above the ball. This condition permits measurement of the retained pressure below the closed valve by the rig standpipe pressure gauges.

FIG. 16 shows the valve for the case when a pump-induced pressure surge from above occurs while the closed mudsaver is connected into the drillstring. In this case, the seat biasing piston 50 is moved away from the ball 85 sufficiently to engage the main seat 75 with the seat travel limiter 65 and unseat seat 75 from ball 85.

Operation of the Embodiments of the Invention:

A major advantage of the mudsaver valve of the present invention is the incorporation of a bi-directional snap action valve. In order to obtain bi-stable snap action for a valve or its actuator, it is necessary to meet the following four conditions for both the opening and closing travel directions: 1) an end travel stop must be provided at each limit of motion; 2) a biasing force which reverses direction and opposes shifting of the valve to another position as the actuator or sealing member moves from one travel stop to the other; 3) the biasing force must be applied to hold the actuator or valve sealing member against or near the end travel stops whenever the actuating forces are less than the biasing forces; and 4) a critical level of actuating force must be applied in the direction of travel such that the resisting forces and biasing forces are exceeded throughout the length of travel for either direction.

These four criteria for bi-directional snap action can be provided by a variety of bistable mechanisms such as garter springs, canted springs, and magnetic mechanisms. Several different means for achieving an adjustable dual snap action are disclosed in copending patent application Ser. No. 09/824,374 entitled "Dual Snap Action for Valves" filed on Apr. 1, 2001, which is incorporated herein by reference.

The general opening and closing operation of the valve 10 is as follows. The ball 85 of the valve 10 is caused to rotate from a closed position for which mud is retained above the ball to an open position for which flow is possible through the ball as a consequence of pressures applied to pressure-responsive actuating piston 162. Biasing forces are applied to piston 162 in order to maintain ball 85 closed when the hydrostatic mud column above ball 85 is exerting pressure on the piston 162. In operation, it is necessary to have an excess of biasing force over hydrostatic pressure-induced force for a variety of conditions, such as surge pressures from movement of the valve for pipe handling or variations in mud weight. Normally, spring 176 provides sufficient bias to handle mud weights necessary for most conditions. The strength of the spring is based upon the maximum height of the mud column to be retained and the desired mud density at which opening is desired. However, additional valve closing bias can be applied by introducing air or nitrogen pressure into chamber 195, so that it will exert additional valve closing forces on piston 162.

Figure 17:
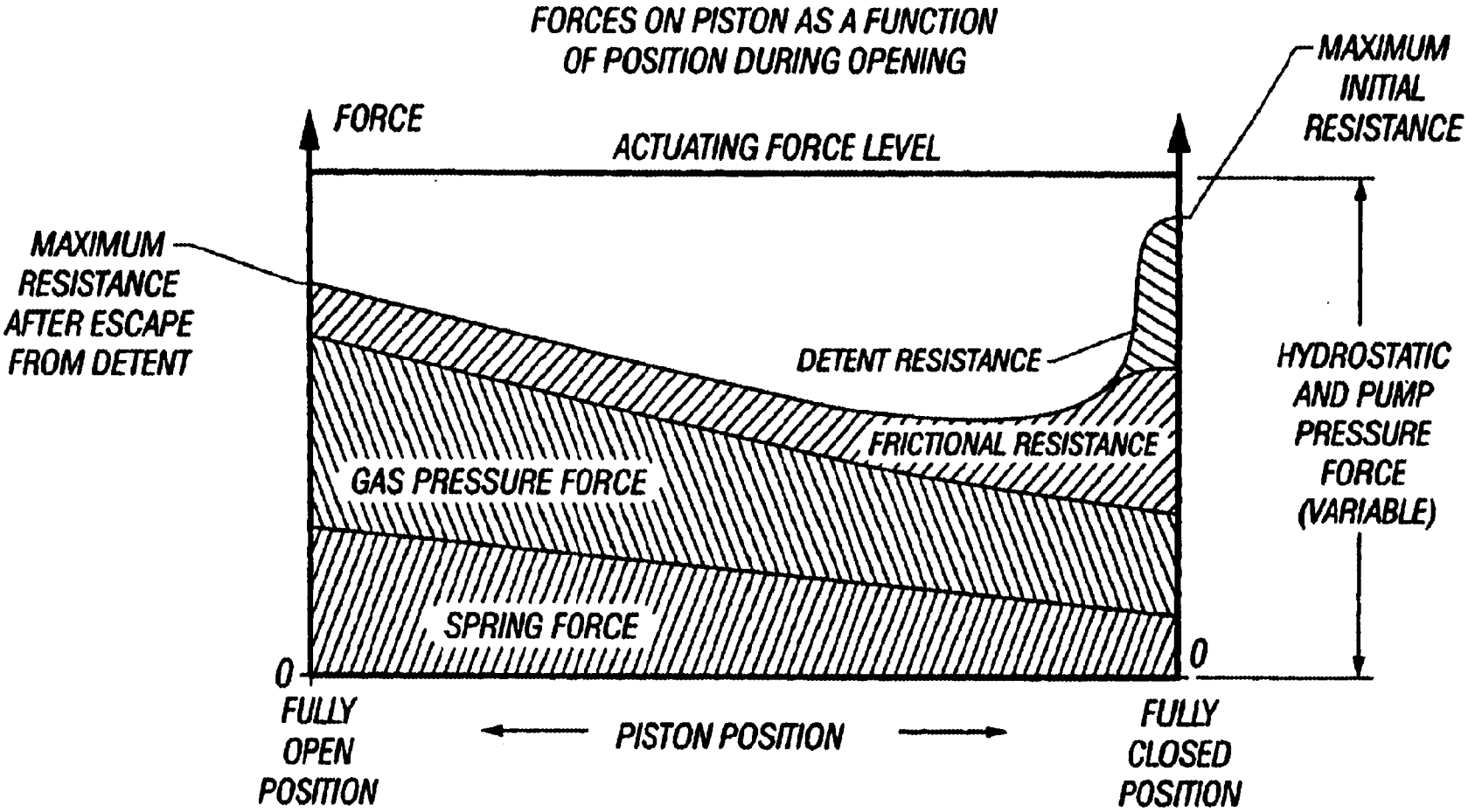
FIG. 17 is a diagram showing the interrelationship of the forces on the piston as a function of position during the opening of the valve.

It is undesirable for a ball valve to be either partially open or partially closed when it is susceptible to flow-induced wear. In addition, a mudsaver valve should be insensitive to lesser variations in either hydrostatic or pump pressure. FIG. 17 shows the relationship of forces acting on the piston 162 as a function of distance of travel for valve opening. These forces are friction, the bias spring force, the gas pressure force, the detent resistance, and the mud pressure force. Both friction and the spring force are predetermined; the gas pressure is adjustable and is set according to the mud density to be retained. The mud pressure force is determined solely by drilling needs and is generally high while drilling. The detenting force is also selectively controllable during fabrication. In addition, the cartridge construction of the valve makes it a simple and rapid process to remove the cartridge, replace the existing detenting members for applying force such as the spring pins 134, with other spring pins of a different biasing force and replace the valve cartridge in the body.

Interaction of spring pins 134 with detents 96 on face 88 of ball 85 provides forces which resist movement of the fully-open or fully-closed ball 85 by the forces applied to piston 162 and thence to the ball 85 by camming arms 152 and camming pins 157. The configuration of detents 96 is selected to coact with the spring forces and spring pin nose geometry of spring pins 134 in order to provide specific forces resisting ball movement. Once resisting forces are overcome by pressure applied to upper surface 174 of piston 163, the unbalanced pressure force is sufficient to cause movement fully to the new assembly position. For example, when the bias of spring 176, precharge pressure in chamber 195, and the resistance of spring pins 134 in the detents 96 of closed ball 85 in FIG. 1 are overcome by pump pressure, the overcoming pressure will force the ball to an open position as shown in FIG. 6.

The excess pressure required to initiate movement of the ball is strictly due to the snap-through action obtained from the resistance of spring pins 134. The spring pin resistance drops to a negligible value after the pin escapes from detent 96. Excess pressure is necessary to overcome the increase of forces from compression of spring 176 and the gas pressure in chamber 195 that occurs with the opening travel of piston 162, as well as to overcome possible variations in friction involved in moving the ball.

Figure 18:
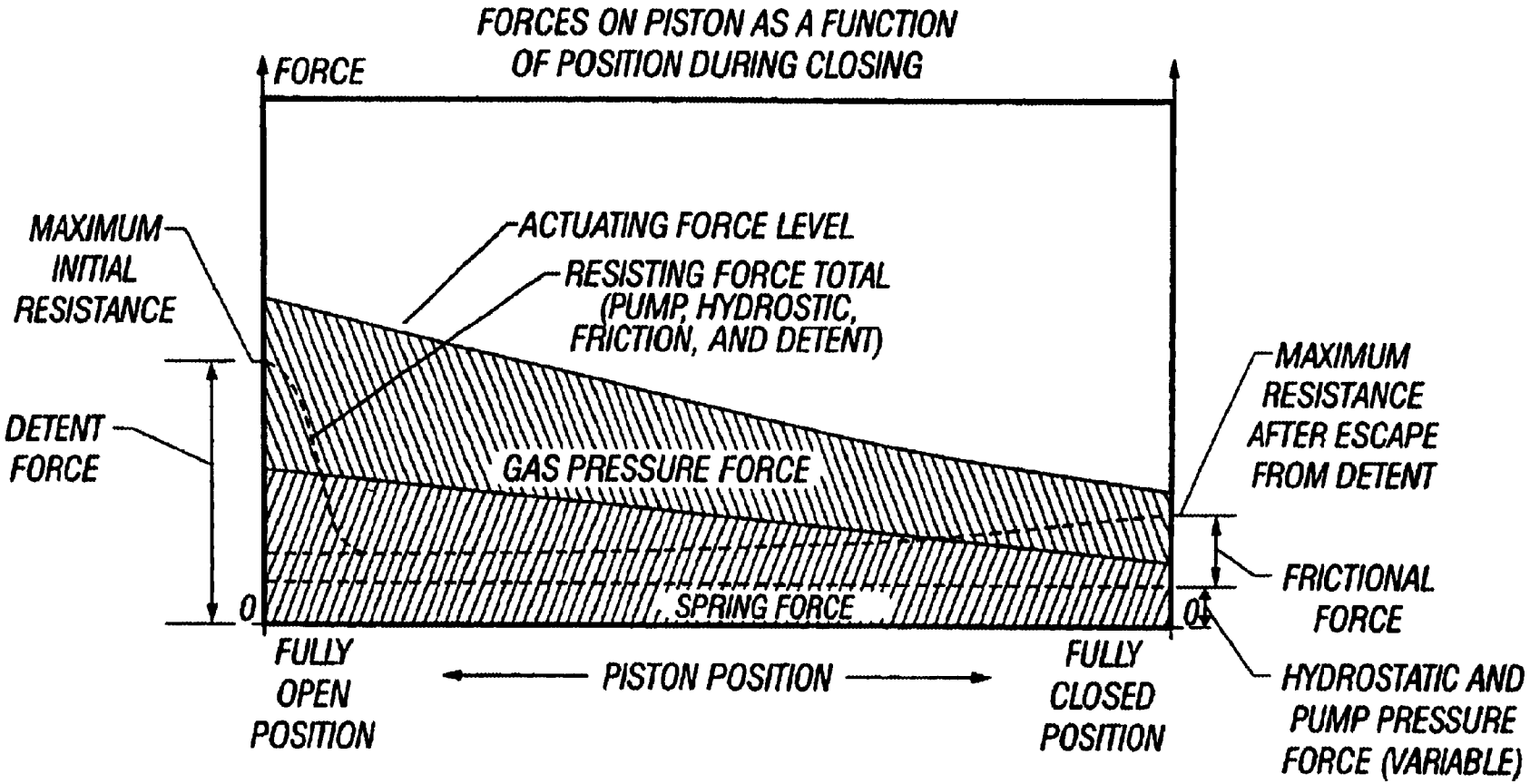
FIG. 18 is a diagram showing the interrelationship of the forces on the piston as a function of position during the closing of the valve.

Excess force on the piston is also required to move the valve from the open position of FIG. 6 to the closed position of FIG. 1, as may be seen from the curves of FIG. 18. For valve closing, the closing effort provided by the combination of the spring bias and the gas pressure force have to overcome friction, the mud pressure forces, and the detent forces. The detent forces should be such that, when the mud pressure drops sufficiently, the gas pressure force and the spring bias will be adequate to overcome friction and thereby ensure full closure. By varying the spring rate of spring pins 134 and the slope and depth of the detents 96 which influence valve opening and closing, the resistive forces of the snap-action mechanism can be made direction dependent.

When the biasing forces on piston 162 and the detent-induced forces on the ball are exceeded during opening, the force on piston 162 is sufficient to move the piston and the attached camming arm 152 downwardly toward the ball 85. As camming arm 152 moves, its attached camming pins 157 interact with camming grooves 94 of ball 85 to cause ball rotation. The reverse action occurs for reclosure of the valve.

Fluid pressure is always communicated from above the ball 85 through the gaps between dirt excluder 140, the camming tubular body 150 and the split half ball cages 100 and 101. This first gap communicates with the gap between ball 85 and valve body 12 and then the cavity between seat 75 and seat bias piston 50 through gap 69 between seat holder 37 and seat travel limiter 65 through multiple holes 68. Thus differential area A1 on seat bias piston 50 is exposed to the pressure above the valve on its upper transverse face and the pressure below the valve on its lower face. Similarly, differential area A2 on the valve seat is exposed to the pressure above the valve on its lower face and the pressure below the valve on its upper face inside the annular sealing ridge 78. In this manner, the seat bias piston 50 and the seat are made responsive to the relative pressure differences between the pressures above and below ball 85. The behavior of the seat in various modes is described further below with reference to FIGS. 14–16. Under normal operating conditions, seat 75 remains in contact with ball 85 when the valve is closed, open, or shifting.

The opening and closing behavior of the valve 210 shown in FIGS. 13A and 13B is identical to that of the first embodiment shown in FIGS. 1 and 6. If a pressure precharge is to be applied to chamber 195 for valve 210, it is done by removing seal screw 173 from body 212 and injecting a predetermined pressure using either air or nitrogen through Schrader valve 171. Seal screw 173 is then replaced to isolate chamber 195 and Schrader valve 171 from external pressures. Latch sleeve 230 is operational only if it is necessary to use a wireline-run lock-open sleeve device 235 to latch the valve 210 open in the event pipe becomes stuck and is inaccessible below the rig floor. In such an event, the lock-open sleeve 235 may be run down the bore of the kelly on wireline while valve 210 is held open by mudpump circulating pressure until it engages in the latch grooves 231 of latch sleeve 230. Lock open sleeve has a nose section which extends through the open ball 85 to constrain it to remain open even when the mud pumps are turned off. After the wireline running tool for lock-open sleeve 235 is retrieved, wireline or pump-down devices can be run through the bore of lock-open sleeve 235 and the open valve 210. Lock-open sleeve 235 can be retrieved in the conventional manner so that the valve 210 can return to its normal functioning pattern. This type of lock-open device can also be applied with the valve of the first embodiment of this invention.

In FIG. 14, the ball 85 is closed and annular sealing ridge 78 of seat 75 is sealing against spherical surface 86 of ball 85, so that mud above the valve is retained. This situation is the normal condition when the pumps of the rig are turned off and the mudsaver valve is disconnected from the drillstring. The pressure of the retained mud is transmitted to the lower transverse face 79 of seat 75, so that seat 75 is biased against the ball by both the differential pressure acting on seat piston area A2 and the force of seat bias spring 80. In this case the seat 75 does not contact the seat travel limiter 65. Seat biasing piston 50 is held against seat holder 37 by the biasing force of conical snap ring 39, which exceeds the force of the retained mud pressure acting on differential seat biasing piston area A1.

In FIG. 15, the valve is shown in its configuration assumed whenever the mudsaver valve is still connected to the drillstring with the pumps off, the ball 85 closed, and higher pressure is present below than above the ball 85. The pressure differential from below acting on area A1 further assists to bias seat bias piston 50 against its stop in seat holder 37. However, when the pressure differential acting on area A2 of seat 75 exceeds the relatively low bias force of seat bias spring 80, seat 75 will be forced away from contact with the spherical surface 86 of ball 85. This separation of seat 75 from sealing engagement with ball 85 permits transmission of pressures (of more than a minimal level due to the bias from spring 80) from below the mudsaver valve to the region above the valve. This automatic transmission of pressure permits the standpipe pressure gauges of the rig to be used to measure the pressure below the valve.

In FIG. 16, the valve is shown in its configuration assumed whenever the valve is reconnected to the drillstring and a pressure surge from the rapid startup of the rig mudpumps encounters the closed valve. This situation does not occur for slow, smooth startups of the rig mudpumps. The bias force applied to the seat bias piston 50 by conical snap ring 39 is such that bias piston 50 remains against its stop in seat holder 37 for any normal hydrostatic mud pressures which may be encountered with the valve closed and separated from the drillstring. Whenever a rapid pump pressure surge encounters the closed ball 85, forces build rapidly in the operating mechanism of the valve, but friction with the valve seat also builds at the same rate since the inertia of the valve prevents instant opening. High contact stresses with attendant wear can occur in a conventional mudsaver in such a situation. However, for the valve of this invention, the pressure differential from the surge acting on area A1 will be sufficient to overcome the bias force of conical snap ring 39 to force seat bias piston 50 away from its stop in seat holder 37. When sufficient movement away from the ball by seat bias piston 50 occurs, transverse lip 67 of seat travel limiter 65 abuts upper transverse face 77 of seat 75 and pulls seat 75 out of engagement with ball 85. The effective differential area exposed to the surge pressure at that time is (A1–A2). This unseating of ball 85 in surge conditions permits the ball to be opened with much lower forces, thus minimizing wear of the valve components. Once the ball is opened, the seat and seat bias piston revert to their normal positions shown in FIG. 14.

Advantages of This Invention:

This invention provides a mudsaver valve that has an extended reliable service by avoiding fluid erosion of valve components caused by fluid wear on a partially open or closed valve. The valve avoids this fluid erosion by using a dual snap action.

A further advantage of the valve is that it is operated with less force and, hence, wear when the pumps are turned on rapidly so that a strong pressure pulse is produced. This advantage results from the unseating of the valve seat for strong pressure pulses from above.

Another advantage of this invention is that it may be readily adjusted to permit operation with high mud densities.

In addition, the valve may be locked open by an accessory tube when it becomes inaccessible downhole due to a stuck pipe, thereby permitting wireline operations through the valve so that the pipe may be freed.

Yet another advantage is that elevated pressure from below is readily transmitted past the valve seat, so that the standpipe pressure of the well can be determined through the valve when the pumps are stopped and still connected to the drillstring.

Still yet another significant advantage of the valve is its modular construction, which may easily be removed from and reinstalled into the valve body without the necessity for handling several loose pieces or dealing with large threaded connections.

It may be seen from the foregoing description that this valve provides a definite improvement in the operation of mudsaver valves, enabling improvements in service life and ease of operation. The disclosed valve will perform substantially better in abrasive service than conventional valves, due to the avoidance of flow concentration during initial valve opening and final valve closing. It is to be understood that this invention is not limited in its application to the details of construction and the arrangement of components set forth in the description or illustrated in the drawings. The invention is capable of other embodiments and of being practiced and carried out in various ways. Also, it is to be understood that the phraseology and terminology employed herein is for the purposes of description and should not be regarded as limiting.

What is claimed is:

1. A mudsaver valve adapted for connection between a kelly or a top drive and a string of drill pipe comprising:

a tubular valve body having a through bore flow passage, said body having means at its lower outlet end for making connection with the string of drill pipe and means at its upper inlet end for making connection with the kelly or the top drive;

a nontranslating rotatable ball having a through hole, said ball rotatable between a first and a second end position about coaxial central pivot pins journaled by a ball support means, wherein when said ball is in the first position, the ball through hole is aligned with said bore flow passage, and when said ball is in the second position, said ball through hole is misaligned with said bore flow passage preventing flow through said bore flow passage;

sealing means for sealingly engaging a spherical surface of said ball;

reciprocable camming means for rotating said ball between said first and second end positions, wherein the reciprocation of said camming means applies a force to the ball eccentric to an axis of rotation of the ball;

a detenting mechanism that interacts with the ball to retain the ball in either end position until sufficient force is applied to the ball to overcome the interaction of the detenting mechanism with the ball; and means for actuating the displacement of said camming means to rotate the ball, said actuating means responsive to valve inlet pressure on a first face and forces on a second face obverse to said first face;

whereby when said actuating means applies sufficient force to said camming means to overcome the interaction of the detenting mechanism with the ball, the ball will rotate from its current end position to the other end position.

2. The mudsaver valve of claim 1, wherein said ball, sealing means, support means, camming means, the detenting mechanism, and actuating means are assembled together to form a modular valve cartridge that fits within the tubular valve body.

3. The mudsaver valve of claim 2, wherein the valve cartridge is retained in said tubular body by a lock ring engaging said tubular body and abutting the cartridge on one end.

4. The mudsaver valve of claim 3, wherein the camming means comprises:

a cylindrical tubular body;

two mirror image arms parallel to the axis of said tubular body and laterally offset from said axis; and two coaxial inwardly protruding camming pins perpendicular to the axis of said tubular body and offset therefrom, one camming pin mounted on each arm and engaging a camming groove, wherein one camming groove is located on and integral to each of a pair of opposed flat faces of the ball;

whereby reciprocation of the camming means causes said camming pins to interact with said camming grooves to rotate the ball.

5. The mudsaver valve of claim 4, wherein each camming groove extends radially parallel to the flat face of the ball at an angle to a flow axis of said ball through hole.

6. The mudsaver valve of claim 1, wherein said actuating means is an annular piston.

7. The mudsaver valve of claim 6, wherein said piston is subjected to a bias force on the second face.

8. The mudsaver valve of claim 7, wherein said bias force includes an adjustable gas pressure force.

9. The mudsaver valve of claim 7, wherein said bias force acts in conjunction with said detenting mechanism to induce snap action behavior for both opening and closing of the valve.

10. The mudsaver valve of claim 1, wherein said detenting mechanism is a spring-pin mounted in the support means for said ball and interacting with one or more detents on said ball.

11. The mudsaver valve of claim 10, wherein the force necessary to overcome the interaction of the spring-pin with the detent on the ball is determined by selecting a spring preload and a spring rate of the spring pin and a slope and a depth of the detent.

12. The mudsaver valve of claim 1, wherein said sealing means comprises a valve seat sealingly engaged on the valve outlet side of the ball and a dirt excluder sealingly engaged on the valve inlet side of the ball.

13. The mudsaver of claim 12, wherein the valve seat is pressure responsive and biased against an outer spherical surface of the ball by a first biasing force, said first biasing force including a spring biasing force and a valve inlet pressure force transmitted from the inlet side of the ball, and wherein the valve seat is biased away from the outer surface of the ball by a second force, said second force including a valve outlet pressure force transmitted from the outlet side of the ball.

14. The mudsaver valve of claim 12, further comprising a valve seat governing means, said governing means comprising:

a travel limiter, reciprocable between an upper position and a lower position, wherein an upper end of the travel limiter reciprocably interacts with the upper end of the valve seat by moving into and out of contact with the valve seat;

a reciprocable biasing piston attached to a lower end of said travel limiter, said biasing piston being pressure responsive, wherein the valve inlet pressure will urge the biasing piston toward a lower position and the valve outlet pressure will urge the biasing piston toward an upper position; and a preloaded spring biasing said biasing piston towards the upper position;

whereby when sufficient inlet pressure force is applied to said preloaded spring to exceed the preload on said preloaded spring, the piston is urged toward the lower position pulling said travel limiter toward said lower position whereby said travel limiter interacts with the valve seat to disengage the valve seat from the outlet side of the ball.

15. The mudsaver valve of claim 1, further comprising a one-piece valve housing.

16. A mudsaver valve adapted for connection between a kelly or top drive and a string of drill pipe comprising:

a tubular valve body having a through bore flow passage, said body having means at its lower end for making connection with a string of drill pipe and means at its upper end for making connection with the kelly or top drive;

a nontranslating rotatable ball having a through hole, said ball rotatable between a first and a second end position, wherein when said ball is in the first position the ball through hole is aligned with said bore flow passage and when said ball is in a second position said ball through hole is misaligned with said bore flow passage preventing flow through said bore flow passage;

a pair of coaxial pivot pins mounted on a pair of opposed flat faces of said ball, said pivot pins transverse to an axis of flow through said ball through hole, wherein said pivot pins are journaled by a support means for said ball, said support means including a ball cage having mirror image split ball cage halves, said ball cage having a cylindrical outer surface closely fitting inside said tubular valve body;

a reciprocable valve seat, wherein an upper end of the valve seat sealingly engages the ball on a lower outlet side;

a dirt excluder, wherein a lower end of the dirt excluder sealingly engages the ball on an upper valve inlet side;

reciprocable camming means for rotating said ball between said first and second end positions;

a detenting mechanism that interacts with the ball to retain the ball in either end position until sufficient force is applied to the ball to overcome the interaction of the detenting mechanism with the ball; and a reciprocable annular piston connected to said camming means, said piston responsive to valve inlet pressure on a first face and force on a second face obverse to said first face;

whereby when said piston applies sufficient force to said camming means to overcome the interaction of the detent means with the ball, the ball will rotate from its current end position to the other end position.

17. The mudsaver valve of claim 16, wherein said piston is subjected to a bias force on the second face, wherein said bias force includes a gas pressure, said bias force adjustable by varying the gas pressure.

18. The mudsaver valve of claim 17, wherein said biasing force includes a biasing spring.

19. The mudsaver valve of claim 16, wherein said detenting mechanism comprises:

a plurality of ball detents located 90° apart in a circular array around said pivot pins; and one or more spring pins mounted in said ball support means equispaced from said pivot pins and engagable with said ball detents.

20. A mudsaver valve comprising:

a cylindrical body having a through bore flow passage and threaded connections on each end for connection with a drill string on the lower outlet end of the valve and a kelly or top drive on the upper inlet end of the valve;

a nontranslating rotatable ball with a though hole which in a first closed position is transverse to the bore flow passage and in a second position is coaxially aligned with the bore flow passage, wherein said ball is rotatable about coaxial central pivot pins, said pivot pins mounted on a pair of opposed flat faces of the ball;

a pair of camming grooves symmetrical about the ball midplane, wherein one camming groove is located on and integral to each flat face of the ball, said camming grooves are inclined to the ball through hole and extend radially;

a valve seat sealingly engaged against said ball on the valve outlet side;

a dirt excluder sealingly engaged against said ball on the valve inlet side;

support means for the ball, said ball support means having coaxial journals for supporting the coaxial central pivot pins of the ball;

reciprocable ball rotation means comprising:

a upper tubular shank coaxial with the valve bore flow passage;

two symmetrically opposed parallel arms, said arms being attached to said cylindrical tube and offset from the tube axis; and two symmetrically opposed camming pins, one camming pin mounted on each arm and each engaging one of said camming grooves;

wherein reciprocation of the ball rotation means causes said camming pins to interact with said camming grooves to rotate said ball;

reciprocable annular piston means attached to said ball rotation means, said piston means having an upper transverse face exposed to the valve inlet pressure and a second obverse transverse face exposed to a reference pressure, wherein said reference pressure is adjustable;

a reference pressure chamber housing interacting with said ball rotation means and said piston to form a sealed reference pressure chamber containing said reference pressure;

biasing spring means situated within said reference pressure chamber, wherein a first end of said spring means bears on the reference pressure chamber housing and a second end of said spring means bears on the second face of the piston; and retaining means for retaining valve components within said cylindrical body.

21. A valve seat assembly comprising:

a valve seat reciprocably sealingly engaged against the outer spherical surface of a ball valving element of a ball valve;

a travel limiter, reciprocable between an upper position and a lower position, wherein an upper end of the travel limiter reciprocably interacts with lost motion with the upper end of the valve seat by moving into and out of contact with said valve seat;

a reciprocable biasing piston fixedly attached to a lower end of said travel limiter, said biasing piston being pressure responsive, wherein a first pressure will urge the biasing piston toward a first position distal to the ball and a second pressure will urge the biasing piston toward a second position proximal to the ball; and a preloaded spring biasing said biasing piston towards the second position;

whereby when the said first pressure sufficiently exceeds the said second pressure, such that the resultant pressure differential force exceeds the preload of said spring, the biasing piston is urged toward the distal position thereby pulling said travel limiter toward said distal position whereby said travel limiter interacts with the valve seat to disengage the valve seat from the outlet side of the ball.

22. A mudsaver valve adapted for connection between either a kelly or a top drive and a drill string including:

(a) a tubular valve body having a counterbore with a latching groove at its upper end and means at its lower outlet end for connecting with the drill string and means at its upper inlet end for making connection with either the kelly or the top drive;

(b) a rotatable, nontranslating ball valving element positioned within the counterbore of said valve body, said ball having:

(i) a throughbored flow passage with a first axis, (ii) symmetrical opposed flats parallel to and offset from said first axis, (iii) coaxial trunnion pins central to and perpendicular to said flats and defining a second axis, and (iv) a mirror-image camming groove in each opposed flat with said camming grooves being inclined at an angle to said first axis, wherein said ball has a first sealing position for which its flow passage is transverse to the axis of the valve body and a second flowing position for which its flow passage is aligned with the flow axis of the body;

(c) split support means for said ball, said support means being of generally tubular construction and adapted to fit closely within the counterbore of said valve body and split on a diametral plane, said support means including:

(i) coaxial journals for supporting the trunnion pins of said ball and having the journal axis normal to the diametral split plane and intersecting the tubular axis of said support means, (ii) opposed symmetrical interior flats comating with the flats of said ball, a first lower end transverse shoulder, an second upper end transverse shoulder at the opposite end from said first end, and a third downward-facing intermediate transverse shoulder adjacent the opposed flats, and (iii) a plurality of elongated, mirror-image about the diametral split plane guide slots parallel to and laterally offset from the tubular axis of said support means;

(d) a pressure responsive annular seat concentric with the flow passage in the valve body and positioned within the counterbore of said valve body on the valve outlet side of said ball, said seat having:

(i) a seat face with an intermediate annular seal zone, wherein the region radially inward of the seal zone is exposed to the valve outlet pressure and wherein the seal zone is configured to sealingly comate with said ball, (ii) a transverse shoulder obverse to the seat face which reacts to a biasing force from a first spring, and (iii) a reduced diameter lower tubular shank having an outer diameter less than that of the diameter of the seal zone which comates and seals against the ball;

(e) seat mounting means of annular construction, said seat mounting means (i) fitting closely to and sealing with the counterbore of the valve body, (ii) abutting the outlet end of said counterbore, and (iii) sealingly comating to the tubular shank of said seat, said seat mounting means having an upward facing transverse shoulder that reacts against the first spring;

(f) the first spring positioned between the said transverse faces of, respectively, the seat and the seat mounting means, said spring serving to bias the seat means against the ball;

(g) reciprocable camming means having a tubular upper shank with an internal flow passage having a counterbore at its lower end and exterior threads at the upper end, said tubular shank supporting integral mirror-image camming arms offset from the tubular axis of said camming means; wherein said camming arms (i) move reciprocably in the guide slots of the split support means when the support means is mounted within the valve body, and (ii) have planar inner faces sufficiently offset from the plane of symmetry of said camming means to admit the flats of said ball between the camming arms;

(iii) mount coaxial camming pins on their planar inner faces, such that said camming pins interact with the camming grooves of the ball to effect rotation of the ball in response to reciprocation of said camming means;

(h) an annular piston sealingly attached to the external threads at the upper end of the camming means, said piston outer diameter being larger than the shank diameter of said camming means, said annular piston having a first upper transverse face, said first upper transverse face exposed to the valve inlet pressure, and a second lower transverse face exposed to a reference pressure and spring biasing forces;

(i) an annular chamber, the chamber exterior surface closely fitting to the counterbore of the valve body, said chamber further having upper and lower transverse ends, said lower end adjoining the upper end of the ball support means and said annular chamber having at its upper interior end a first bore sealing with the exterior of the annular piston and having at its lower interior end a second bore sealing with the shank of the camming means with an enlarged bore positioned between the said first and second bores;

(j) an annular bias chamber formed from said enlarged bore, said biasing chamber having transverse upper and lower ends, wherein the configuration of the bias chamber permits mounting a biasing spring within and retaining pressure within the boundaries of the volume enclosed between the annular chamber, the camming means, and the annular piston;

(k) charging means for selectably introducing gas pressure within said bias chamber and thereby biasing said piston upwardly;

(l) the biasing spring inserted within the bias chamber of the annular chamber to bear against the lower transverse end of said bias chamber and also bear against the lower transverse end of said annular piston, thereby further biasing said piston upwardly;

(m) annular dirt excluder means with an upper shank and a lower upset head having a lower spherical face conforming to the exterior of the ball and further having an upper transverse shoulder, wherein the upper shank outer diameter is sufficiently smaller than the counterbore of the flow passage of the camming means, wherein said dirt excluder means is mounted within the counterbore of said camming means and has a lower spherical face contacting the ball, wherein such mounting produces a fluid flow passage between the dirt excluder means and the camming means and thence around the exterior of the ball so that the transverse shoulder obverse to the face of the annular seat means is exposed to valve inlet pressure;

(n) one or more dirt excluder bias springs which are mounted around the shank of the dirt excluder means and which bear on the upper transverse shoulder of the upset head of the dirt excluder means and on the third downwardly facing transverse shoulder of the split support means in order to bias said dirt excluder means against the ball;

(o) annular split ring retention means having a through bore and engagable with the latching groove of said valve body and abutting the transverse upper face of said annular chamber to retain the components of the valve within the body; and (p) an annular backup ring configured to closely fit inside the through bore of said split ring retention means to prevent disengagement of said retention means from said latching groove of the valve body;

whereby when said annular piston is subjected to sufficient net force in the downward direction the camming means is caused to translate downwardly and the valve is opened and, further, when said annular piston is subjected to sufficient net upward force in the upward direction, the camming means is caused to translate upwardly and the valve is closed.

23. In a ball valve adapted for use as a mudsaver installed between a kelly or a top drive and a string of drill pipe, the improvement comprising:

a ball rotatable between a first and a second end position about coaxial central pivot pins, wherein when said ball is in the first end position the valve is open and when the ball is in the second end position the valve is closed, said ball having a plurality of detents on a surface of said ball; and a detenting mechanism that engages the detents on the ball to retain the ball in either end position until sufficient force is applied to the ball to overcome the interaction of the detenting mechanism with the detent so that the ball is compelled to move fully from its current end position to its other end position.

24. The ball valve of claim 23, further comprising means for adjusting the force necessary to overcome the interaction of the detenting mechanism with the detent.

25. A mudsaver valve adapted for connection between a kelly or a top drive and a string of drill pipe comprising:

a tubular valve body having a through bore flow passage, said body having means at its lower outlet end for making connection with the string of drill pipe and means at its upper inlet end for making connection with the kelly or the top drive;

a nontranslating rotatable ball having a through hole, said ball rotatable between a first and a second end position about coaxial central pivot pins journaled by a ball support means, wherein when said ball is in the first position, the ball through hole is aligned with said bore flow passage, and when said ball is in the second position, said ball through hole is misaligned with said bore flow passage preventing flow through said bore flow passage;

sealing means for sealingly engaging a spherical surface of said ball, wherein said sealing means comprises a valve seat sealingly engaged on the valve outlet side of the ball and a dirt excluder sealingly engaged on the valve inlet side of the ball;

a valve seat governing means, said governing means comprising:

a travel limiter, reciprocable between an upper position and a lower position, wherein an upper end of the travel limiter reciprocably interacts with the upper end of the valve seat by moving into and out of contact with the valve seat, a reciprocable biasing piston attached to a lower end of said travel limiter, said biasing piston being pressure responsive, wherein the valve inlet pressure will urge the biasing piston toward a lower position and the valve outlet pressure will urge the biasing piston toward an upper position, and a preloaded spring biasing said biasing piston towards the upper position, wherein when sufficient inlet pressure force is applied to said preloaded spring to exceed the preload on said preloaded spring, the piston is urged toward the lower position pulling said travel limiter toward said lower position whereby said travel limiter interacts with the valve seat to disengage the valve seat from the outlet side of the ball;

reciprocable camming means for rotating said ball between said first and second end positions, wherein the reciprocation of said camming means applies a force to the ball eccentric to an axis of rotation of the ball;

a detenting mechanism that interacts with the ball to retain the ball in either end position until sufficient force is applied to the ball to overcome the interaction of the detenting mechanism with the ball; and means for actuating the displacement of said camming means to rotate the ball, said actuating means responsive to valve inlet pressure on a first face and forces on a second face obverse to said first face;

whereby when said actuating means applies sufficient force to said camming means to overcome the interaction of the detenting mechanism with the ball, the ball will rotate from its current end position to the other end position.

* * * * *